US012203482B2

(12) United States Patent
Macqueen et al.

(10) Patent No.: US 12,203,482 B2
(45) Date of Patent: Jan. 21, 2025

(54) NOZZLE FOR A FAN ASSEMBLY

(71) Applicant: Dyson Technology Limited, Wiltshire (GB)

(72) Inventors: Neil Ewen Callum Macqueen, Bristol (GB); Philip Tennison Reilly, Oxford (GB); Darren Matthew Lewis, Bristol (GB); James Dyson, Singapore (SG); Alexander Stuart Knox, Swindon (GB)

(73) Assignee: Dyson Technology Limited, Malmesbury (GB)

( * ) Notice: Subject to any disclaimer, the term of this patent is extended or adjusted under 35 U.S.C. 154(b) by 398 days.

(21) Appl. No.: 17/254,715

(22) PCT Filed: Jun. 19, 2019

(86) PCT No.: PCT/GB2019/051713
§ 371 (c)(1),
(2) Date: Dec. 21, 2020

(87) PCT Pub. No.: WO2020/002877
PCT Pub. Date: Jan. 2, 2020

(65) Prior Publication Data

US 2021/0270283 A1 Sep. 2, 2021

(30) Foreign Application Priority Data

Jun. 27, 2018 (GB) ..... 1810539

(51) Int. Cl.
*F04D 29/40* (2006.01)
*F04D 29/26* (2006.01)
*F04F 5/46* (2006.01)

(52) U.S. Cl.
CPC ..... *F04D 29/26* (2013.01); *F04F 5/461* (2013.01)

(58) Field of Classification Search
CPC ..... F04D 29/26; F04F 5/461
See application file for complete search history.

(56) References Cited

U.S. PATENT DOCUMENTS 2,488,467 A 11/1949 De Lisio
3,047,208 A * 7/1962 Coanda ..... F04F 5/16 417/174

(Continued)

FOREIGN PATENT DOCUMENTS

CN 2185861 Y 12/1994
CN 1993243 A 7/2007

(Continued)

OTHER PUBLICATIONS

English Translation of WO-2018058892-A1 (Fei) obtained Mar. 9, 2023 (Year: 2018).*

(Continued)

*Primary Examiner* — Connor J Tremarche
(74) *Attorney, Agent, or Firm* — Tucker Ellis LLP

(57) ABSTRACT

There is provided a nozzle for a fan assembly. The nozzle comprises an air inlet for receiving an air flow, a first air outlet for emitting an air flow and a second air outlet for emitting an air flow. The first and second air outlets comprise a pair of curved slots that are provided on a face of the nozzle, and the first and second air outlets are oriented towards a convergent point. The first air outlet and the second air outlet may be oriented towards a convergent point that is located on a central axis of the face of the nozzle.

19 Claims, 13 Drawing Sheets

(56) References Cited

U.S. PATENT DOCUMENTS

| | | | | |
|---|---|---|---|---|
| 3,362,494 | A | 1/1968 | Boehler et al. | |
| 3,774,262 | A | 11/1973 | Anthony et al. | |
| 3,823,653 | A | 7/1974 | Roos | |
| 4,220,145 | A | 9/1980 | Stamp et al. | |
| 4,395,201 | A | 7/1983 | Bron | |
| 4,431,135 | A * | 2/1984 | Kaye | B05B 1/005 417/198 |
| 5,411,371 | A | 5/1995 | Chen | |
| 5,524,827 | A | 6/1996 | Znamensky et al. | |
| 5,762,034 | A * | 6/1998 | Foss | F01P 5/06 415/914 |
| 5,821,475 | A | 10/1998 | Morehead et al. | |
| 6,156,085 | A | 12/2000 | Chiu et al. | |
| 6,341,760 | B1 | 1/2002 | Rawlings | |
| 6,604,694 | B1 * | 8/2003 | Kordas | B01D 46/04 239/398 |
| 8,308,445 | B2 | 11/2012 | Gammack et al. | |
| 8,734,121 | B2 * | 5/2014 | Tsen | F04F 5/16 417/198 |
| 2002/0020457 | A1 * | 2/2002 | Yamamoto | D03D 47/48 139/434 |
| 2008/0014855 | A1 | 1/2008 | Leserre | |
| 2009/0047892 | A1 | 2/2009 | Brancheriau et al. | |
| 2010/0014959 | A1 | 1/2010 | Azzouz et al. | |
| 2012/0034108 | A1 | 2/2012 | Wallace et al. | |
| 2012/0051884 | A1 * | 3/2012 | Junkel | F04F 5/16 415/90 |
| 2012/0093630 | A1 * | 4/2012 | Fitton | F04D 25/08 415/90 |
| 2012/0263573 | A1 | 10/2012 | Tadokoro et al. | |
| 2013/0104415 | A1 | 5/2013 | Han et al. | |
| 2013/0280051 | A1 | 10/2013 | Nicolas et al. | |
| 2014/0210114 | A1 * | 7/2014 | Staniforth | F24F 6/14 261/30 |
| 2014/0255173 | A1 * | 9/2014 | Poulton | F04D 25/08 415/182.1 |
| 2014/0286747 | A1 | 9/2014 | Fang et al. | |
| 2014/0348658 | A1 | 11/2014 | Cunnane | |
| 2015/0300663 | A1 | 10/2015 | Hirakawa et al. | |
| 2016/0121695 | A1 | 5/2016 | Sakurai | |
| 2016/0152116 | A1 | 6/2016 | Albin et al. | |
| 2017/0087500 | A1 * | 3/2017 | Combs | F24F 11/0001 |
| 2017/0094903 | A1 | 4/2017 | Baes et al. | |
| 2017/0190240 | A1 * | 7/2017 | Paris | B60H 1/345 |
| 2018/0064303 | A1 | 3/2018 | Meggle et al. | |
| 2018/0080676 | A1 | 3/2018 | Cho et al. | |
| 2018/0353923 | A1 | 12/2018 | Hoener et al. | |
| 2019/0118340 | A1 | 4/2019 | Mase | |
| 2019/0315200 | A1 | 10/2019 | Pestke | |
| 2019/0345946 | A1 * | 11/2019 | Register | F04D 17/04 |
| 2020/0178749 | A1 | 6/2020 | Royale et al. | |
| 2021/0270282 | A1 | 9/2021 | MacQueen et al. | |
| 2021/0270284 | A1 | 9/2021 | Jukes et al. | |
| 2021/0270292 | A1 | 9/2021 | MacQueen | |
| 2021/0381518 | A1 | 12/2021 | Horton et al. | |
| 2023/0028614 | A1 | 1/2023 | Marcel et al. | |
| 2023/0383758 | A1 | 11/2023 | Horton et al. | |

FOREIGN PATENT DOCUMENTS

| | | | |
|---|---|---|---|
| CN | 101649842 | A | 2/2010 |
| CN | 101985949 | A | 3/2011 |
| CN | 102235385 | A | 11/2011 |
| CN | 103133300 | A | 6/2013 |
| CN | 203272264 | U | 11/2013 |
| CN | 103807149 | A | 5/2014 |
| CN | 203627312 | U | 6/2014 |
| CN | 203770175 | U | 8/2014 |
| CN | 204084763 | U | 1/2015 |
| CN | 104895768 | A | 9/2015 |
| CN | 105041625 | A | 11/2015 |
| CN | 105508311 | A | 4/2016 |
| CN | 105644302 | A | 6/2016 |
| CN | 106123272 | A | 11/2016 |
| CN | 106286327 | A | 1/2017 |
| CN | 206035913 | U | 3/2017 |
| CN | 106573522 | A | 4/2017 |
| CN | 106884815 | A | 6/2017 |
| CN | 106969482 | A | 7/2017 |
| CN | 207317217 | U | 5/2018 |
| CN | 210829911 | U | 6/2020 |
| CN | 211174828 | U | 8/2020 |
| CN | 211231040 | U | 8/2020 |
| CN | 211343521 | U | 8/2020 |
| CN | 211901107 | U | 11/2020 |
| DE | 3644590 | A1 | 7/1988 |
| DE | 10350949 | A1 | 11/2004 |
| DE | 102015001477 | A1 | 12/2015 |
| DE | 102015116242 | B3 | 9/2016 |
| DE | 102016107227 | A1 | 10/2017 |
| EP | 0610866 | A1 | 8/1994 |
| EP | 3321114 | A1 | 5/2018 |
| FR | 2772311 | A1 | 6/1999 |
| FR | 3034175 | A1 | 9/2016 |
| GB | 1347978 | A | 2/1974 |
| GB | 2463698 | A | 3/2010 |
| GB | 2482549 | A | 2/2012 |
| GB | 2493672 | A | 2/2013 |
| GB | 2496464 | A | 5/2013 |
| GB | 2499042 | A | 8/2013 |
| GB | 2502103 | A | 11/2013 |
| GB | 2578616 | A | 5/2020 |
| JP | 861-195235 | A | 8/1986 |
| JP | 861-195235 | U | 12/1986 |
| JP | 03-244959 | A | 10/1991 |
| JP | 06-313603 | A | 11/1994 |
| JP | 2004-322981 | A | 11/2004 |
| JP | 2009-204240 | A | 9/2009 |
| JP | 2012-030718 | A | 2/2012 |
| JP | 2012-145308 | A | 8/2012 |
| JP | 2014-058257 | A | 4/2014 |
| JP | 2014-088774 | A | 5/2014 |
| JP | 2014-234936 | A | 12/2014 |
| JP | 5663051 | B2 | 2/2015 |
| JP | 2015-175309 | A | 10/2015 |
| KR | 10-0225915 | B1 | 7/1999 |
| KR | 10-1601325 | B1 | 3/2016 |
| KR | 10-1647382 | B1 | 8/2016 |
| KR | 10-1735432 | B1 | 5/2017 |
| TW | 336963 | | 8/1999 |
| WO | 99/07569 | A1 | 2/1999 |
| WO | 2010/100451 | A1 | 9/2010 |
| WO | 2013/035271 | A1 | 3/2013 |
| WO | 2014/075399 | A1 | 5/2014 |
| WO | 2017/050754 | A1 | 3/2017 |
| WO | WO-2018058892 | A1 * | 4/2018 ..... F04D 17/08 |
| WO | 2020/002877 | A1 | 1/2020 |
| WO | 2020/089579 | A1 | 5/2020 |
| WO | 2020/089580 | A1 | 5/2020 |
| WO | 2020/089581 | A1 | 5/2020 |
| WO | 2022/269222 | A1 | 12/2022 |

OTHER PUBLICATIONS

Singapore Search Report and Written Opinion Received for SG Application No. 11202009931S, mailed on May 20, 2022, 8 pages.

Office Action received for Patent Application No. KR 10-2021-7000200, mailed on May 20, 2022, 13 pages (7 pages of English Translation and 6 pages of Original Document).

Office Action received for Patent Application No. KR 10-2021-7000470, mailed on May 20, 2022, 11 pages (6 pages of English Translation and 5 pages of Original Document).

Evaluation Report dated Aug. 10, 2020, directed to CN Application No. ZL2019209769775; 13 pages.

Evaluation Report of Patentability of Utility Model dated Nov. 11, 2020, directed to CN Application No. ZL201920989943X; 14 pages.

International Search Report and Written Opinion received for PCT Patent Application No. PCT/GB2019/051712, mailed on Sep. 24, 2019, 9 pages.

(56) References Cited

OTHER PUBLICATIONS

International Search Report and Written Opinion received for PCT Patent Application No. PCT/GB2019/051714, mailed on Sep. 24, 2019, 9 pages.
International Search Report and Written Opinion received for PCT Patent Application No. PCT/GB2019/051715, mailed on Oct. 2, 2019, 8 pages.
Office Action received for Chinese Patent Application No. 201910559580.0, mailed on Jul. 2, 2021, 22 pages (14 pages of English Translation and 8 pages of Original Document).
Office Action received for Chinese Patent Application No. 201910566663.2, mailed on Jul. 2, 2021, 25 pages (15 pages of English Translation and 10 pages of Original Document).
Search Report dated Dec. 10, 2018, directed to GB Application No. 1810538.7; 1 page.
Search Report dated Dec. 19, 2018, directed to GB Application No. 1810540.3; 1 page.
Search Report dated Dec. 19, 2018, directed to GB Application No. 1810541.1; 1 page.
The First Office Action dated Dec. 7, 2020, directed to CN Application No. 201910559831.5; 18 pages.
The First Office Action dated Oct. 12, 2020, directed to CN Application No. 201910566663.2; 13 pages.
Evaluation Report dated Jul. 15, 2020, directed to CN Application No. ZL201920977040X; 13 pages.
International Search Report and Written Opinion mailed Sep. 25, 2019, directed to International Application No. PCT/GB2019/051713; 12 pages.
Search Report dated Dec. 10, 2018, directed to GB Application No. 1810539.5; 1 page.
The First Office Action dated Oct. 12, 2020, directed to CN Application No. 201910559580.0; 16 pages.
Evaluation Report dated Nov. 16, 2020, directed to CN Application No. ZL2019218644124; 13 pages.
International Search Report and Written Opinion mailed Dec. 17, 2019, directed to International Application No. PCT/GB2019/052834; 11 pages.
Search Report dated Apr. 30, 2019, directed to GB Application No. 1817852.5; 1 page.
The First Office Action dated May 6, 2021, directed to CN Application No. 201911050925.6; 15 pages.
Fei et al., WO 2018/058892, 2018, English Machine Translation (Year: 2018).
Combined Search and Examination Report received for GB Application No. 2313951.2, mailed on Oct. 17, 2023, 2 pages.
Examination Report received for GB Application No. 2108927.1, mailed on Sep. 4, 2023, 2 pages.
International Search Report and Written Opinion received for PCT Patent Application No. PCT/GB2022/051314, mailed on Aug. 31, 2022, 12 pages.
International Search Report and Written Opinion received for PCT Patent Application No. PCT/GB2022/051315, mailed on Aug. 31, 2022, 10 pages.
Search Report received for GB Application No. 2108924.8, mailed on Nov. 30, 2021, 1 page.
Search Report received for GB Application No. 2108927.1, mailed on Dec. 2, 2021, 1 page.

* cited by examiner

NOZZLE FOR A FAN ASSEMBLY

REFERENCE TO RELATED APPLICATIONS

This application is a national phase application under 35 USC 371 of International Application No. PCT/GB2019/051713, filed Jun. 19, 2019, which claims the priority of United Kingdom Application No. 1810539.5, filed Jun. 27, 2018, the entire contents of each of which are incorporated herein by reference.

FIELD OF THE DISCLOSURE

The present invention relates to a nozzle for a fan assembly, and a fan assembly comprising such a nozzle.

BACKGROUND OF THE DISCLOSURE

A conventional domestic fan typically includes a set of blades or vanes mounted for rotation about an axis, and drive apparatus for rotating the set of blades to generate an airflow. The movement and circulation of the airflow creates a 'wind chill' or breeze and, as a result, the user experiences a cooling effect as heat is dissipated through convection and evaporation. The blades are generally located within a cage which allows an airflow to pass through the housing while preventing users from coming into contact with the rotating blades during use of the fan.

U.S. Pat. No. 2,488,467 describes a fan which does not use caged blades to project air from the fan assembly. Instead, the fan assembly comprises a base which houses a motor-driven impeller for drawing an airflow into the base, and a series of concentric, annular nozzles connected to the base and each comprising an annular outlet located at the front of the nozzle for emitting the airflow from the fan. Each nozzle extends about a bore axis to define a bore about which the nozzle extends.

Each nozzle is in the shape of an airfoil may therefore be considered to have a leading edge located at the rear of the nozzle, a trailing edge located at the front of the nozzle, and a chord line extending between the leading and trailing edges. In U.S. Pat. No. 2,488,467 the chord line of each nozzle is parallel to the bore axis of the nozzles. The air outlet is located on the chord line, and is arranged to emit the airflow in a direction extending away from the nozzle and along the chord line.

Another fan assembly which does not use caged blades to project air from the fan assembly is described in WO 2010/100451. This fan assembly comprises a cylindrical base which also houses a motor-driven impeller for drawing a primary airflow into the base, and a single annular nozzle connected to the base and comprising an annular mouth/outlet through which the primary airflow is emitted from the fan. The nozzle defines an opening through which air in the local environment of the fan assembly is drawn by the primary airflow emitted from the mouth, amplifying the primary airflow. The nozzle includes a Coanda surface over which the mouth is arranged to direct the primary airflow. The Coanda surface extends symmetrically about the central axis of the opening so that the airflow generated by the fan assembly is in the form of an annular jet having a cylindrical or frusto-conical profile.

The user is able to change the direction in which the air flow is emitted from the nozzle in one of two ways. The base includes an oscillation mechanism which can be actuated to cause the nozzle and part of the base to oscillate about a vertical axis passing through the centre of the base so that that air flow generated by the fan assembly is swept about an arc of around 180°. The base also includes a tilting mechanism to allow the nozzle and an upper part of the base to be tilted relative to a lower part of the base by an angle of up to 10° to the horizontal.

SUMMARY OF THE DISCLOSURE

According a first aspect there is provided a nozzle for a fan assembly. The nozzle comprises an air inlet for receiving an air flow, a first air outlet for emitting an air flow and a second air outlet for emitting an air flow. The first and second air outlets comprise a pair of curved slots that are provided on a face of the nozzle, and the first and second air outlets are diametrically opposed and oriented towards a convergent point. The nozzle further comprises an intermediate surface that spans an area between the first and second air outlets. In other words, the intermediate surface extends across the distance that separates the first and second air outlets. The first and second air outlets are discrete. In other words, the first air outlet and the second air outlet are physically separated from one another. Preferably, the intermediate surface is outward facing, i.e. faces away from the centre of the nozzle.

The face of the nozzle may comprise the intermediate surface. The intermediate surface may extend at least partially across the face the nozzle. The intermediate surface may be flat or at least partially convex. The first air outlet and the second air outlet may be oriented towards a convergent point that is located on a central axis of the face of the nozzle.

The nozzle may further comprise a nozzle body or outer casing that defines one or more outermost surface of the nozzle. The nozzle body or outer casing therefore substantially defines the external shape or form of the nozzle. The face of the nozzle may therefore comprise the intermediate surface and a portion of the nozzle body that extends around or surrounds the periphery of the intermediate surface. The nozzle body may define an opening and the intermediate surface may then be exposed within the opening. The opening may be provided at the face of the nozzle.

The intermediate surface may define a portion of the first and second air outlets. The first air outlet may defined by a first portion of the nozzle body and a first portion of the intermediate surface and the second air outlet may be defined by a second portion of the nozzle body and a second portion of the intermediate surface. The nozzle may define a generally elliptical opening or gap between the intermediate surface and the nozzle body, and the pair of curved slots may then be provided by separate portions of the opening. Portions of the opening between the pair of curved slots may each be occluded by one or more covers. The one or more covers may be moveable between a closed position in which the portions of the opening between the pair of curved slots are occluded and an open position in which the portions of the opening between the pair of curved slots are open. Alternatively, the one or more covers are fixed, and then preferably are integral with one or more of the nozzle body and the intermediate surface of the nozzle.

Preferably, the curved slots are arcuate. More preferably, the curved slots are shaped as arcs of a single circle and are diametrically opposed to one another. The curved slots may therefore comprise two congruent arcuate slots that are diametrically opposed on the face of the nozzle body, and are preferably shaped as circular arcs.

The first and second air outlets may be oriented to direct an air flow over at least a portion of the intermediate surface.

The first and second air outlets may be arranged to direct the air flow emitted therefrom such that the air flow passes across at least a portion of the intermediate surface. The first and second air outlets may be arranged to direct an air flow over a portion of the intermediate surface that is adjacent to the respective air outlet.

A forwardmost point of an outer wall of the nozzle may be in front of a forwardmost point of the intermediate surface. Alternatively, a forwardmost point of an outer wall of the nozzle may be flush with a forwardmost point of the intermediate surface.

The nozzle may have an elliptical face. Preferably, the nozzle has a circular face. The opening may then be generally annular. Preferably, the nozzle is generally cylindrical, ellipsoidal or spheroidal in shape. In particular, the nozzle may have the general shape of a right circular cylinder or truncated sphere. Preferably, the nozzle has the general shape of a truncated sphere, with a first truncation forming the face of the nozzle and a second truncation forming at least part of a base of the nozzle.

The nozzle may further comprise a base that is arranged to be connected to a fan assembly, and the base may then define the air inlet of the nozzle. The angle of the face of the nozzle relative to the base may be fixed. Preferably, the angle of the face of the nozzle relative to the base is from 0 to 90 degrees, is more preferably from 0 to 45 degrees, and is yet more preferably from 20 to 35 degrees.

The nozzle may further comprise a single internal air passageway extending between the air inlet and both the first and second air outlets. The nozzle may further comprise a valve for controlling an air flow from the air inlet to the air outlets. Preferably, the first and second air outlets together define a combined/aggregate air outlet of the nozzle, and the valve then comprises one or more valve members which are moveable to adjust the size of the first air outlet relative to the size of the second air outlet while keeping the size of the combined/aggregate air outlet of the nozzle constant. The valve may comprise one or more valve members that are moveable to simultaneously adjust the size of the first air outlet and inversely adjust the size of the second air outlet. The valve may be arranged such that movement of the one or more valve members simultaneously adjusts the size of the first air outlet and inversely adjusts the size of the second air outlet whilst keeping the aggregate size of the first and second air outlets constant. Preferably, the one or more valve members are moveable through a range of positions between a first end position in which the first air outlet is maximally occluded and the second air outlet is maximally open and a second end position in which the first air outlet is maximally open and the second air outlet is maximally occluded.

The one or more valve members may be arranged to move translationally (i.e. without rotation), and preferably rectilinearly (i.e. in a straight line). The one or more valve members may be arranged to move laterally relative to a body of the nozzle, and optionally may also be arranged to move laterally relative to the external guide surface.

For each of the valve members, the valve member may have a shape that corresponds with a shape of an opposing portion of the nozzle body. In particular, the valve member may have a radius of curvature that is substantially equal to a radius of curvature of the opposing portion of the nozzle body.

According to a second aspect there is provided a nozzle for a fan assembly. The nozzle comprises an air inlet for receiving an air flow, a first air outlet for emitting an air flow and a second air outlet for emitting an air flow. The first and second air outlets comprise a pair of curved slots that are provided on a face of the nozzle, and the first and second air outlets are oriented towards a convergent point. The first air outlet and the second air outlet may be oriented towards a convergent point that is located on a central axis of the face of the nozzle.

According to a third aspect of the present invention there is provided a fan assembly comprising an impeller, a motor for rotating the impeller to generate an air flow, and a nozzle according to any of the first and second aspect for receiving the air flow. The fan assembly may comprise a base upon which the fan assembly is supported, and an angle of the face of the nozzle relative to the base of the fan assembly may be fixed. Preferably, the angle of the face of the nozzle relative to the base of the fan assembly is from 0 to 90 degrees, is preferably from 0 to 45 degrees, and is more preferably from 20 to 35 degrees. The base of the fan assembly is preferably provided at a first end of a body of the fan assembly, and the nozzle is then preferably mounted to an opposite second end of the body of the fan assembly. Preferably, the motor and the impeller are housed within the body of the fan assembly.

BRIEF DESCRIPTION OF THE FIGURES

An embodiment of the present invention will now be described, by way of example only, with reference to the accompanying drawings, in which.

DETAILED DESCRIPTION OF THE DISCLOSURE

Figure 2:
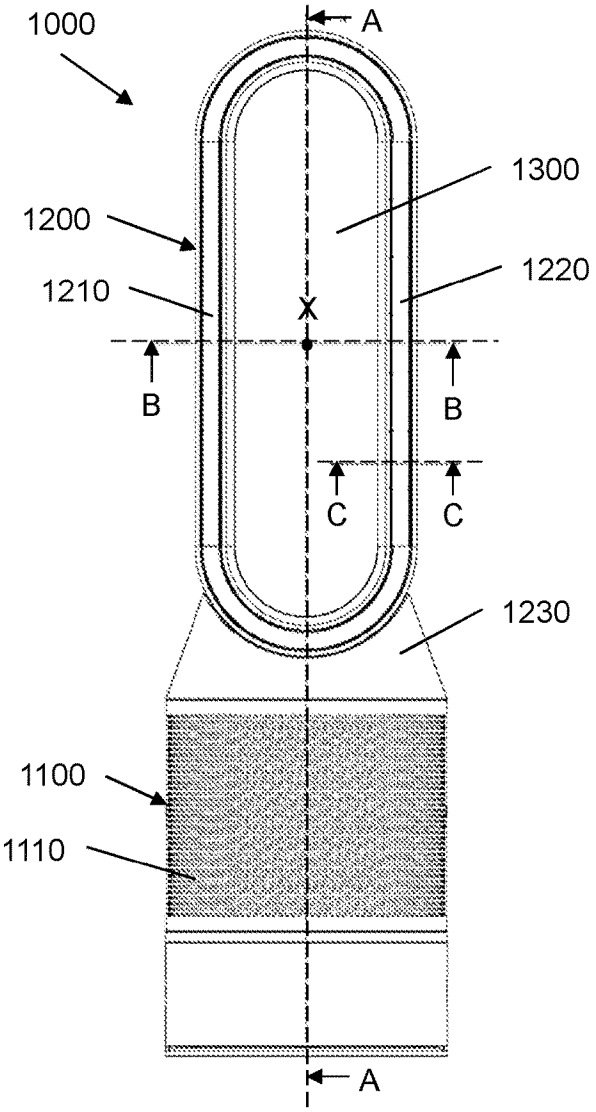
FIG. 2 is a front view of the fan assembly of FIG. 1.

There will now be described a nozzle for a fan assembly which is capable of generating a well-focussed jet of air with high flow rate and low pressure drop thereby providing improved energy efficiency. The term "fan assembly" as used herein refers to a fan assembly configured to generate and deliver an airflow for the purposes of thermal comfort and/or environmental or climate control. Such a fan assembly may be capable of generating one or more of a dehumidified airflow, a humidified airflow, a purified airflow, a filtered airflow, a cooled airflow, and a heated airflow.

The nozzle comprises an air inlet for receiving an air flow, a first air outlet for emitting an air flow and a second air outlet for emitting an air flow. The first and second air outlets comprise a pair of curved slots that are provided on a face of the nozzle that are diametrically opposed and oriented towards a convergent point. The first and second air outlets are therefore discrete (i.e. are physically separated from one another). The nozzle further comprises an intermediate surface that spans an area between the first and second air outlets. In other words, the intermediate surface extends across the area or space that separates the first and second air outlets. This intermediate surface comprises an external surface of the nozzle and is preferably outward facing (i.e. faces away from the centre of the nozzle). The first and second air outlets are discrete (i.e. are physically separated from one another).

The face of the nozzle may comprise the intermediate surface. The intermediate surface may then extend at least partially across the face the nozzle. The intermediate surface may be flat or at least partially convex. The first air outlet and the second air outlet may be oriented towards a convergent point that is located on a central axis of the face of the nozzle.

The nozzle may further comprise a nozzle body or outer casing that defines one or more outermost surface of the nozzle. The nozzle body or outer casing therefore substantially defines the external shape or form of the nozzle. The face of the nozzle may therefore comprise the intermediate surface and a portion of the nozzle body that extends around or surrounds the periphery of the intermediate surface. The nozzle body may define an opening and the intermediate surface may then be exposed within the opening such that the intermediate surface provides an external surface of the nozzle. The opening may be provided at the face of the nozzle.

The intermediate surface may define a portion of the first and second air outlets. In particular, the first air outlet may defined by a first portion of the nozzle body and a first portion of the intermediate surface and the second air outlet may be defined by a second portion of the nozzle body and a second portion of the intermediate surface. The first portion of the intermediate surface (i.e. that partially defines the first air outlet) may have a shape that corresponds with a shape of the opposing, first portion of the nozzle body. In particular, the first portion of the intermediate surface may have a radius of curvature that is substantially equal to a radius of curvature of the opposing, first portion of the nozzle body. The second portion of the intermediate surface (i.e. that partially defines the second air outlet) may have a shape that corresponds with a shape of the opposing, second portion of the nozzle body. In particular, the second portion of the intermediate surface may have a radius of curvature that is substantially equal to a radius of curvature of the opposing, second portion of the nozzle body.

The nozzle may define a generally elliptical opening or gap between the intermediate surface and the nozzle body, and the pair of curved slots may then be provided by separate portions of the opening. Portions of the opening between the pair of curved slots may each be occluded by one or more covers. The one or more covers may be moveable between a closed position in which the portions of the opening between the pair of curved slots are occluded and an open position in which the portions of the opening between the pair of curved slots are open. Alternatively, the one or more covers are fixed, and then preferably are integral with one or more of the nozzle body and the intermediate surface of the nozzle.

It is preferable that the curved slots are arcuate. The term "arcuate" as used herein refers to the shape of an arc, wherein an arc is a segment or part of a curve. An arc that comprises a segment of an ellipse is called an elliptical arc. More preferably the curved slots comprise two congruent arcuate slots that are diametrically opposed on the face of the nozzle body, and are preferably shaped as circular arcs. The term "congruent arcs" as used herein refers to arcs of the same ellipse that have the same arc measure/arc angle.

The term "air outlet" as used herein refers to a portion of the nozzle through which an air flow escapes from the nozzle. In particular, in the embodiments described herein, each air outlet comprises a conduit or duct that is defined by the nozzle and through which an air flow exits the nozzle. Each air outlet could therefore alternatively be referred to as an exhaust. This contrasts with other portions of the nozzle that are upstream from the air outlets and that serve to channel an air flow between an air inlet of the nozzle and an air outlet.

It is preferable that the first and second air outlets are each oriented to direct an emitted air flow over at least a portion of the intermediate surface. In other words, the first and second air outlets may be arranged to direct the air flow emitted therefrom such that the air flow passes across at least a portion of the intermediate surface. In particular, the first and second air outlets may be arranged to direct an air flow over a portion of the intermediate surface that is adjacent to the respective air outlet. Preferably, the first and second air outlets are oriented to emit an air flow in a direction that is substantially parallel to a portion of this intermediate surface that is adjacent to the air outlet. It is then preferable that the intermediate surface is shaped so that the intermediate surface diverges or veers away from the direction in which the air flows are emitted from the first and second air outlets so that these air flows can collide at and/or around the convergent point without interference from the intermediate surface. Emitting the air flows across the intermediate surface minimizes disruption of the air flows as they initially leave the nozzle, with the subsequent departure of the air flows from the intermediate surface then allowing for the formation a separation bubble between the intermediate surface, the emitted air flows and the convergent point. The formation of a separation bubble can assist in stabilizing the resultant jet or combined air flow formed when the two opposing air flows collide. This intermediate surface of the nozzle can therefore be considered to be an external guide surface that assists in guiding the air flows emitted from the first and second air outlets to the convergent point.

Figure 1:
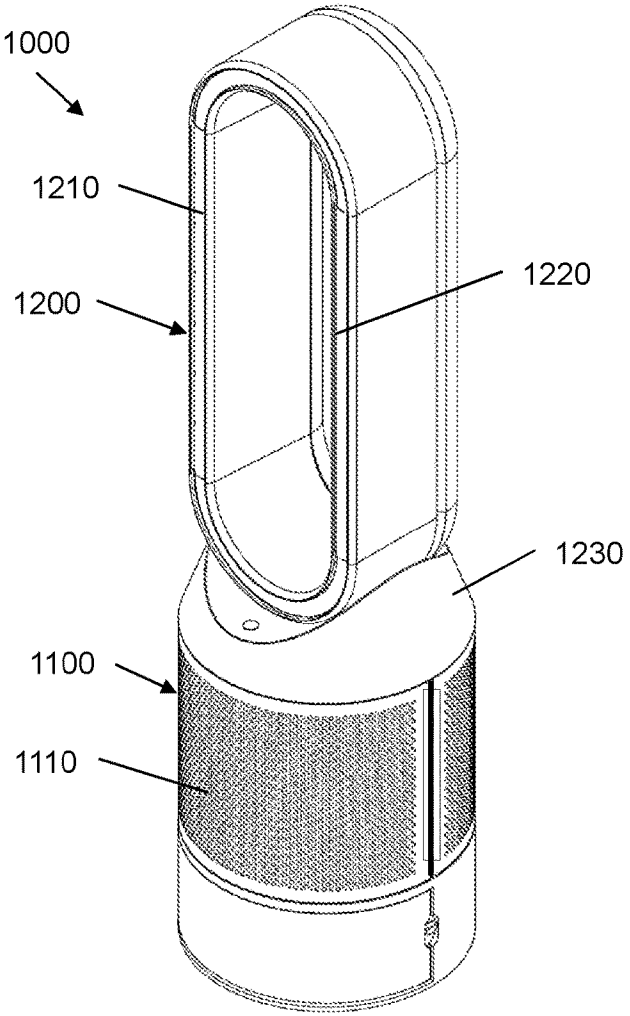
FIG. 1 is a perspective view of a fan assembly.

FIGS. 1 and 2 are external views of a fan assembly 1000 that has an elongate annular nozzle 1200. The nozzle 1200 therefore comprises two parallel, straight sections 1201, 1202 each adjacent a respective elongate side of an opening 1300, an upper curved section 1203 joining the upper ends of the straight sections 1201, 1202, and a lower curved section 1204 joining the lower ends of the straight sections 1201, 1202. The upper and lower curved section 1203, 1204 of the elongate annular nozzle 1200 are blocked so that no air flow can exit the elongate annular nozzle 1200 through the curved sections 1203, 1204. Rather, the air flow is permitted to exit the elongate annular nozzle 1200 through separate elongate, linear air outlets 1210, 1220 which extend along the parallel side sections 1201, 1202 of the elongate annular nozzle 1200.

Figure 3:
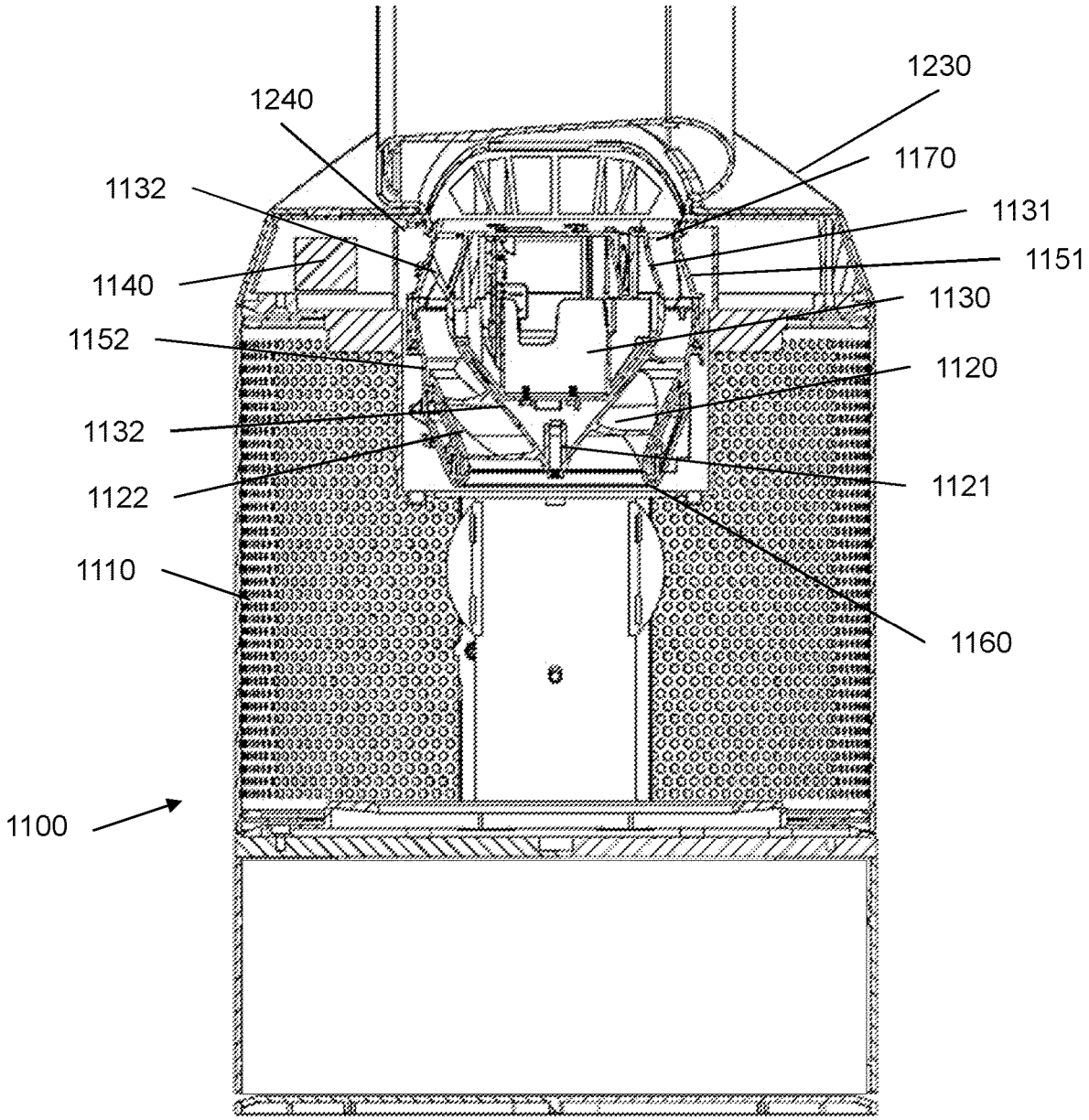
FIG. 3 is a sectional view take along line A-A of FIG. 2.
Figure 4:
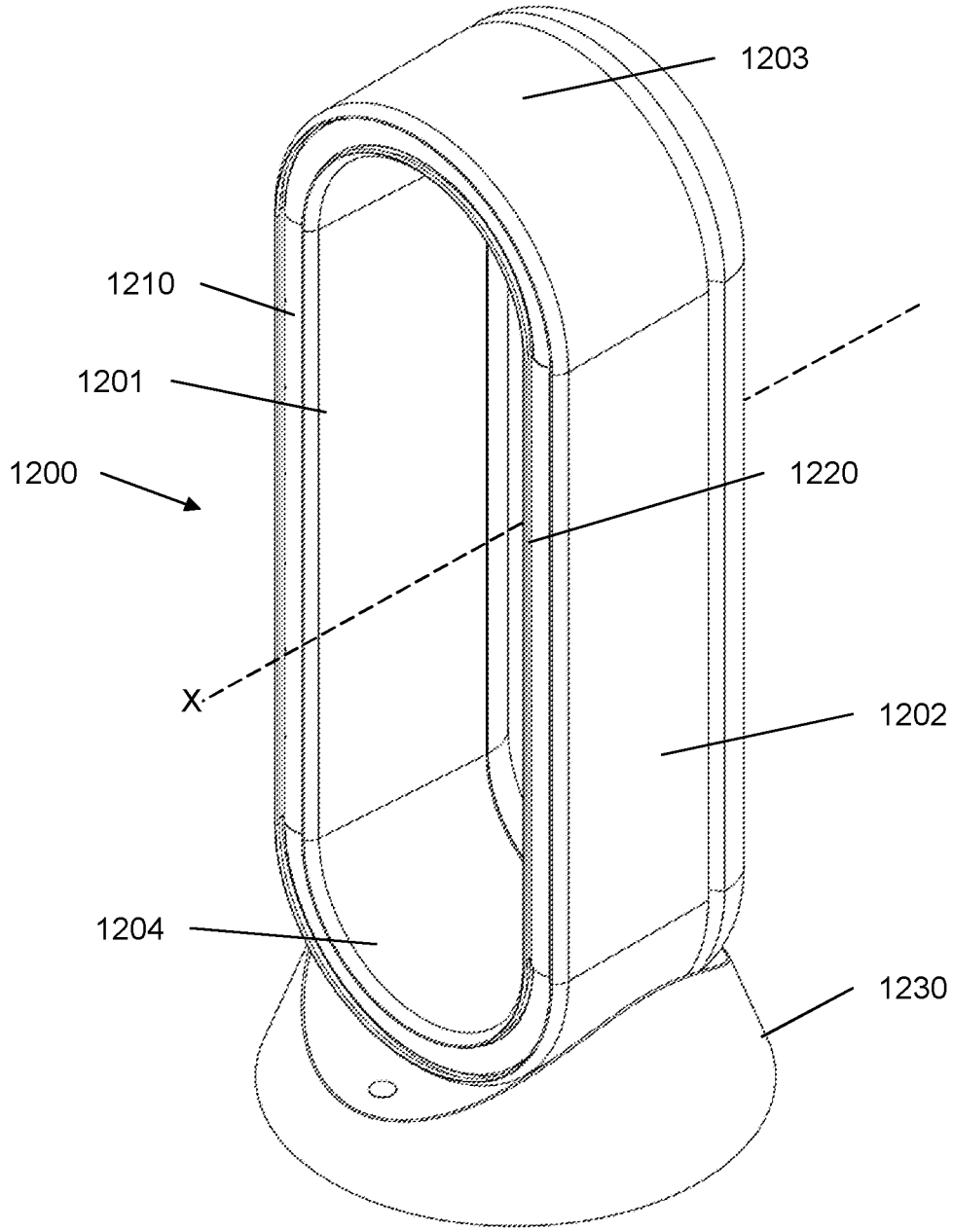
FIG. 4 is a perspective view of the annular nozzle of the fan assembly of FIG. 1.

FIG. 1 shows a perspective view of the fan assembly 1000 and FIG. 2 is a front view of the fan assembly 1000. FIG. 3 then shows a sectional view through a body or stand 1100 of the fan assembly taken along lines A-A of FIG. 2, whilst FIG. 4 shows a perspective view of a nozzle 1200 of the fan assembly 1000. The fan assembly 1000 comprises the body or stand 1100 with the elongate annular nozzle 1200 being mounted on the body 1100. The body 1100 is substantially cylindrical and comprises an air inlet 1110 through which an airflow enters the body 1100 of the fan assembly 1000, and the air inlet 1110 comprises an array of apertures formed in the body 1100. Alternatively, the air inlet 1110 may comprise one or more grilles or meshes mounted within windows formed in the body 1100.

FIG. 3 illustrates a sectional view through the fan assembly 1000. The body 1100 houses the impeller 1120 for drawing an airflow through the air inlet 1110 and into the body 1100. The impeller 1120 is connected to a rotary shaft 1121 extending outwardly from a motor 1130. In the fan assembly illustrated in FIG. 3, the motor 1130 is a DC brushless motor having a speed which is variable by a control circuit 1140 in response to control inputs provided by a user. The motor 1130 is housed within a motor housing that comprises an upper portion 1131 connected to a lower portion 1132. The upper portion 1131 of the motor housing further comprises an annular diffuser 1132 in the form of curved blades that project from the outer surface of the upper portion 1131 of the motor housing.

The motor housing 1131, 1132 is mounted within a duct that is mounted within the body 1100. The duct comprises a generally frusto-conical upper wall 1151, a generally frusto-conical lower wall 1152 and an impeller shroud 1122 located within and abutting against the lower wall 1152. A substantially annular inlet member 1160 is then connected to the bottom of the duct for guiding the primary airflow into the impeller housing. An air inlet of the duct is therefore defined by the annular inlet member 1160 provided at the bottom end of the duct. An air vent/opening 1170, through which the primary airflow is exhausted from the body 1100, is then defined by the upper portion 1131 of the motor housing and the upper wall 1151 of the duct.

A flexible sealing member (not shown) is attached between the upper wall 1151 of the duct and the body 1110 to prevent air from passing around the outer surface of the duct to the inlet member 1160. The sealing member preferably comprises an annular lip seal, preferably formed from rubber.

The nozzle 1200 is mounted on the upper end of the body 1110 over the air vent 1170 through which the primary airflow exits the body 1100. The nozzle 1200 comprises a neck/base 1230 that connects to upper end of the body 1100 and has an open lower end which provides an air inlet 1240 for receiving the primary airflow from the body 1100. The external surface of the base 1230 of the nozzle 1200 is then substantially flush with the outer edge of the body 1100. The base 1230 therefore comprises a housing that covers/encloses any components of the fan assembly 1000 that are provided on an upper surface of the body 1100, which in FIG. 3 includes the control circuit 1140.

As described above, the nozzle 1200 has an elongate annular shape, often referred to as a stadium or discorect-angle shape, and defines a correspondingly shaped opening or bore 1300 having a height (as measured in a direction extending from the upper end of the nozzle to the lower end of the nozzle 1200) greater than its width (as measured in a direction extending between the side walls of the nozzle 1200), and a central axis (X).

The air inlet 1240 of the elongate annular nozzle 1200 is arranged to receive an air flow from the air vent/opening 1170 through which the primary airflow is exhausted from the body 1100. A single internal air passageway 1250 extends around the elongate annular nozzle 1200 and receives the air from the air inlet 1240. When air flows from the air vent/opening 1170 into the air inlet 1240 of the elongate annular nozzle 1200 it is split in two and flows in opposite angular directions about the bore 1300 of the elongate annular nozzle 1200 through the internal air passageway 1250. Air guide vanes (not shown) are provided on an inner surface of the parallel side sections 1201, 1202 to turn the vertically oriented air flow through 90° towards the linear air outlets 1210, 1220 which are provided on a forward facing surface of the elongate annular nozzle 1200.

Figure 6:
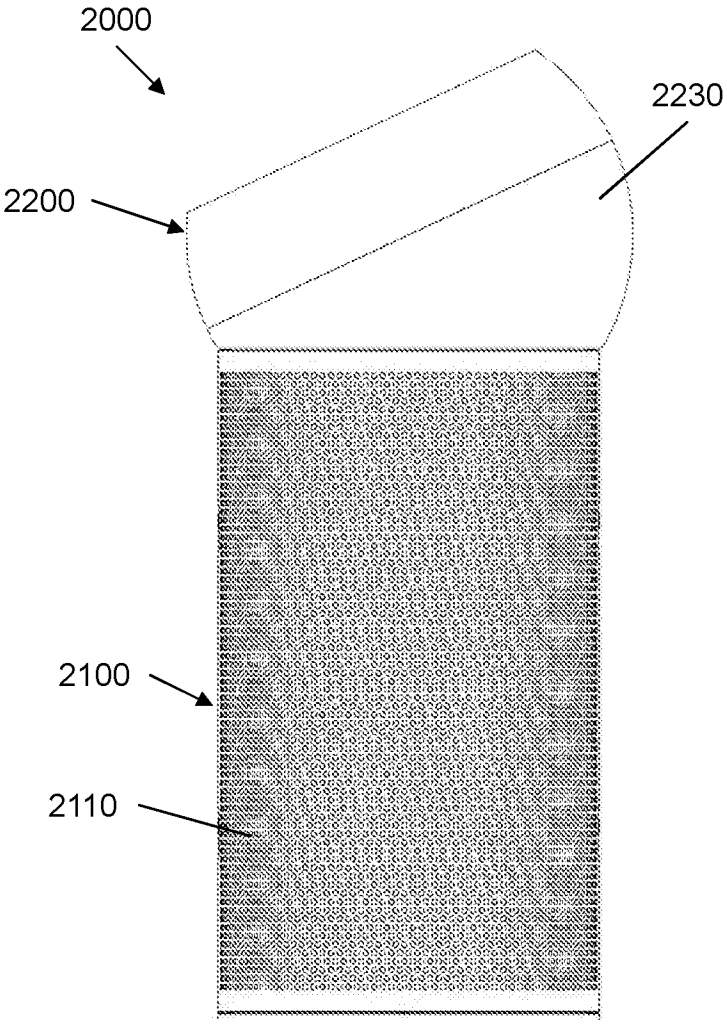
FIG. 6 is a side view of the fan assembly of FIG. 5.
Figure 5:
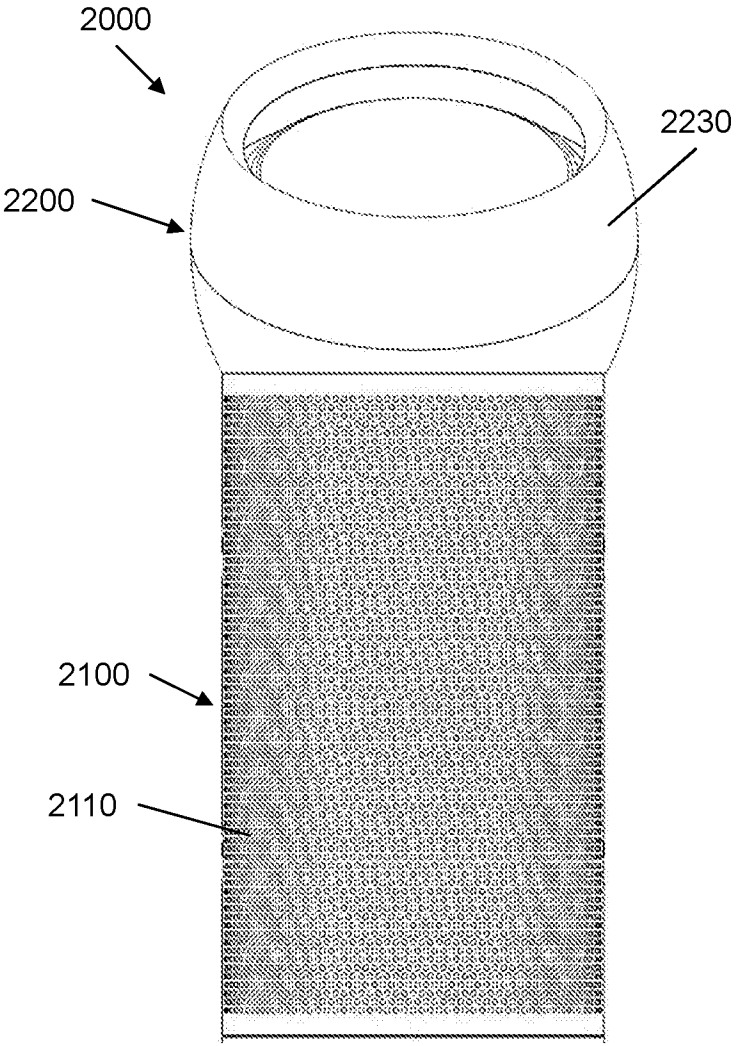
FIG. 5 is a front view of a first embodiment of a fan assembly.

FIGS. 5 and 6 then show a first embodiment of a fan assembly 2000 according to the present invention. Although the fan assemblies 1000, 2000 look quite different the bodies 1100, 2100 of the fan assemblies are essentially the same. For this reason the description of the body 2100 will not be repeated. However, as can clearly be seen, a key difference between the fan assemblies 1000, 2000 is that the fan assembly 2000 of FIGS. 5 and 6 does not have an elongate annular nozzle with linear air outlets. Rather, the nozzle 2200 of the fan assembly 2000 has the general shape of a truncated sphere with the air outlets 2210, 2220 of the nozzle 2200 comprising a pair curved slots provided on a face 2231 of the nozzle 2000.

In the illustrated embodiment, the nozzle 2200 is mounted on the upper end of the body 2110 over the air vent through which an airflow exits the body 2100. The nozzle 2200 has an open lower end which provides an air inlet 2240 for receiving the airflow from the body 2100. The external surface of an outer wall of the nozzle 2200 then converges with the outer edge of the body 2100.

The nozzle 2200 comprises a nozzle body, outer casing or housing 2230 that defines the outermost surfaces of the nozzle and therefore defines the external shape or form of the nozzle 2200. In the illustrated embodiment, the nozzle body/outer casing 2230 of the nozzle 2200 has the general shape of a truncated sphere, with a first truncation forming a circular face 2231 of the nozzle and a second truncation forming a circular base 2232 of the nozzle body/outer casing 2230, and the angle ($\alpha$) of the face 2231 of the nozzle body 2230 relative to the base 2232 of the nozzle body 2230 is fixed. In the illustrated embodiment, this angle ($\alpha$) is approximately 25 degrees; however, the angle of the face 2231 relative to the base 2232 of the nozzle body 2230 could be anything from 0 to 90 degrees, is more preferably from 0 to 45 degrees, and is yet more preferably from 20 to 35 degrees.

In the illustrated embodiment, the first truncation provides that the diameter ($D_N$) of the nozzle body 2230 is approximately 1.2 times greater than the diameter ($D_F$) of the circular face 2231 of the nozzle body 2230; however, the diameter ($D_N$) of the nozzle body 2230 could be anything from 1.05 to 2 times greater than a diameter ($D_F$) of the circular face 2231 of the nozzle body, and is preferably from 1.1 to 1.4 times greater. The second truncation then provides that diameter ($D_N$) of the nozzle body 2230 is also approximately 1.2 times greater than the diameter ($D_B$) of the circular base 2232 of the nozzle body 2230; however, the diameter ($D_N$) of the nozzle body 2230 could be anything from 1.05 to 2 times greater than the diameter ($D_B$) of the circular base 2232 of the nozzle body 2230, and is preferably from 1.1 to 1.4 times greater.

The nozzle body 2230 defines an opening at the circular face 2231 of the nozzle body 2230. The nozzle 2200 then further comprises a fixed, external guide surface 2250 that is located concentrically within the opening at the circular face 2231 of the nozzle body 2230 such that this external guide surface 2250 is at least partially exposed within the opening, with a portion of the nozzle body 2230 extending around the periphery of the guide surface 2250. The external guide surface 2250 is therefore outward facing (i.e. faces away from the centre of the nozzle).

In the illustrated embodiment, this guide surface 2250 is convex and substantially disk-shaped; however, in alternative embodiments the guide surface 2250 could be flat or only partially convex. An inwardly curved upper portion 2230*a* of the nozzle body 2230 then overlaps/overhangs a circumferential portion 2250*a* of the guide surface 2250. The outermost, central portion 2250*b* of the convex guide surface is then offset relative to the outermost point of the open circular face 2231 of the nozzle body 2230. In particular, the outermost point of the open circular face 2231 of the nozzle body 2230 is in front of the outermost portion 2250*b* of the guide surface.

The circumferential portion 2250*a* of the guide surface 2250 and an opposing portion of the nozzle body 2230 together define a generally annular gap 2260 between them, with two diametrically opposed portions of this gap 2260 then forming a pair of congruent, circular arc shaped slots that provide the first and second air outlets 2210, 2220 of the nozzle 2200. The guide surface 2250 therefore provides an intermediate surface that spans the area between the first and second air outlets 2210, 2220. In other words, the guide surface 2250 forms an intermediate surface that extends across the space that separates the first and second air outlets 2210, 2220. As will be described in more detail below, in at least one configuration of the nozzle 2200, the portions of the gap 2260 that separate the pair of arcuate slots are then covered/occluded.

In the illustrated embodiment, the pair of arcuate slots that provide the first and second air outlets 2210, 2220 each have an arc angle (β) (i.e. the angle subtended by the arc at the centre of the circular face 2231) of approximately 60 degrees; however, they could each have an arc angle of anything from 20 to 110 degrees, preferably from 45 to 90 degrees, and more preferably from 60 to 80 degrees. Consequently, the area of the gap 2260 can be anything from 3 to 18 times greater than the area of each of the first and second air outlets 2210, 2220, is preferably from 4 to 8 times greater, and is more preferably from 4 to 6 times greater.

The first and second air outlets 2210, 2220 are approximately the same size and together form an aggregate or combined air outlet of the spherical nozzle 2200. The first air outlet 2210 and the second air outlet 2220 are located on opposing sides of the guide surface 2250, and are orientated to direct an emitted air flow over a portion of the guide surface 2250 that is adjacent to the respective air outlet and towards a convergent point that is aligned with a central axis (Y) of the guide surface 2250. The first air outlet 2210, the second air outlet 2220 and the guide surface 2250 are then arranged such that emitted air flows are directed over a portion of the guide surface 2250 that is adjacent to the respective air outlet. In particular, the air outlets 2210, 2220 are arranged to emit an air flow in a direction that is substantially parallel to the portion of the guide surface 2250 adjacent the air outlet 2210, 2220. The convex shape of the guide surface 2250 then provides that the air flows emitted from the first and second air outlets 2210, 2220 will depart from the guide surface 2250 as they approach the convergent point so that these air flows can collide at and/or around the convergent point without interference from the guide surface 2250. When the emitted air flows collide, a separation bubble is formed that can assist in stabilising the resultant jet or combined air flow formed when two opposing air flows collide.

Figure 7:
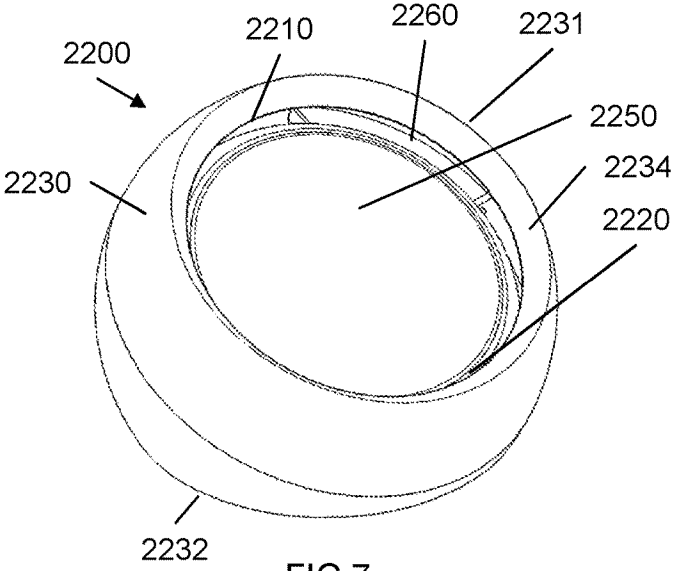
FIG. 7 is a perspective view of the spherical nozzle of the fan assembly of FIGS. 5 and 6.
Figure 8:
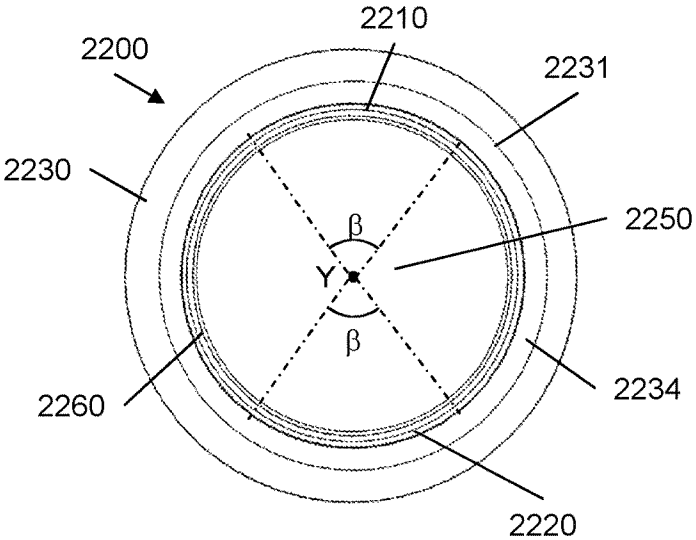
FIG. 8 is a top view of the spherical nozzle of the fan assembly of FIGS. 5 and 6.
Figure 9:
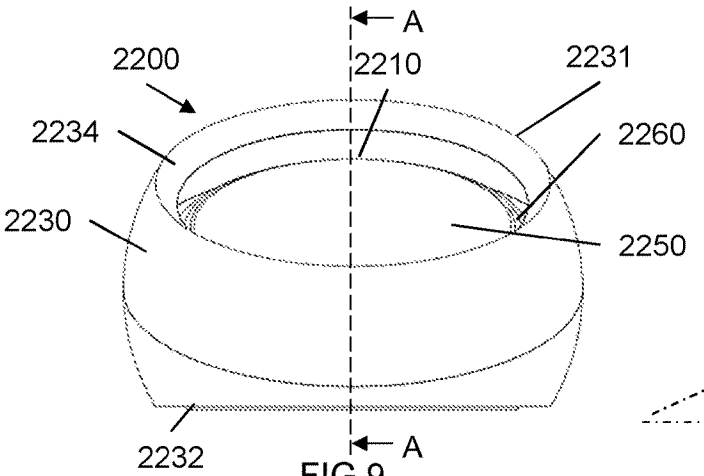
FIG. 9 is a front view of the spherical nozzle of the fan assembly of FIGS. 5 and 6.
Figure 10:
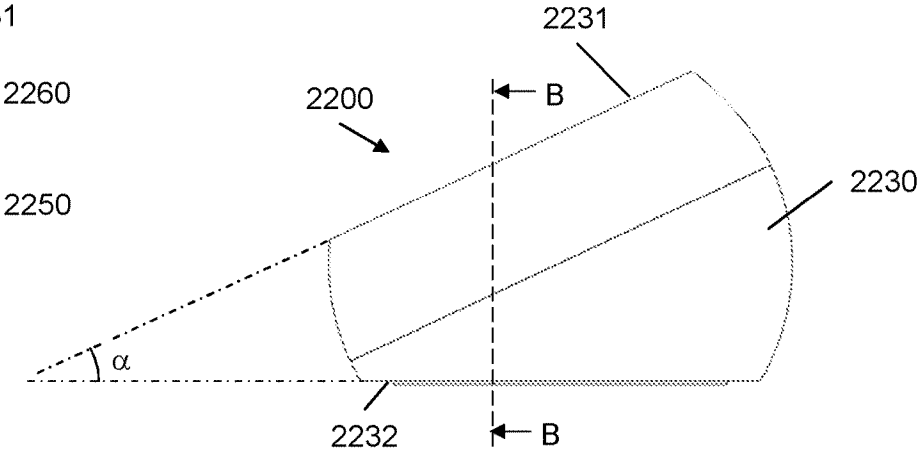
FIG. 10 is a side view of the spherical nozzle of the fan assembly of FIGS. 5 and 6.
Figure 11:
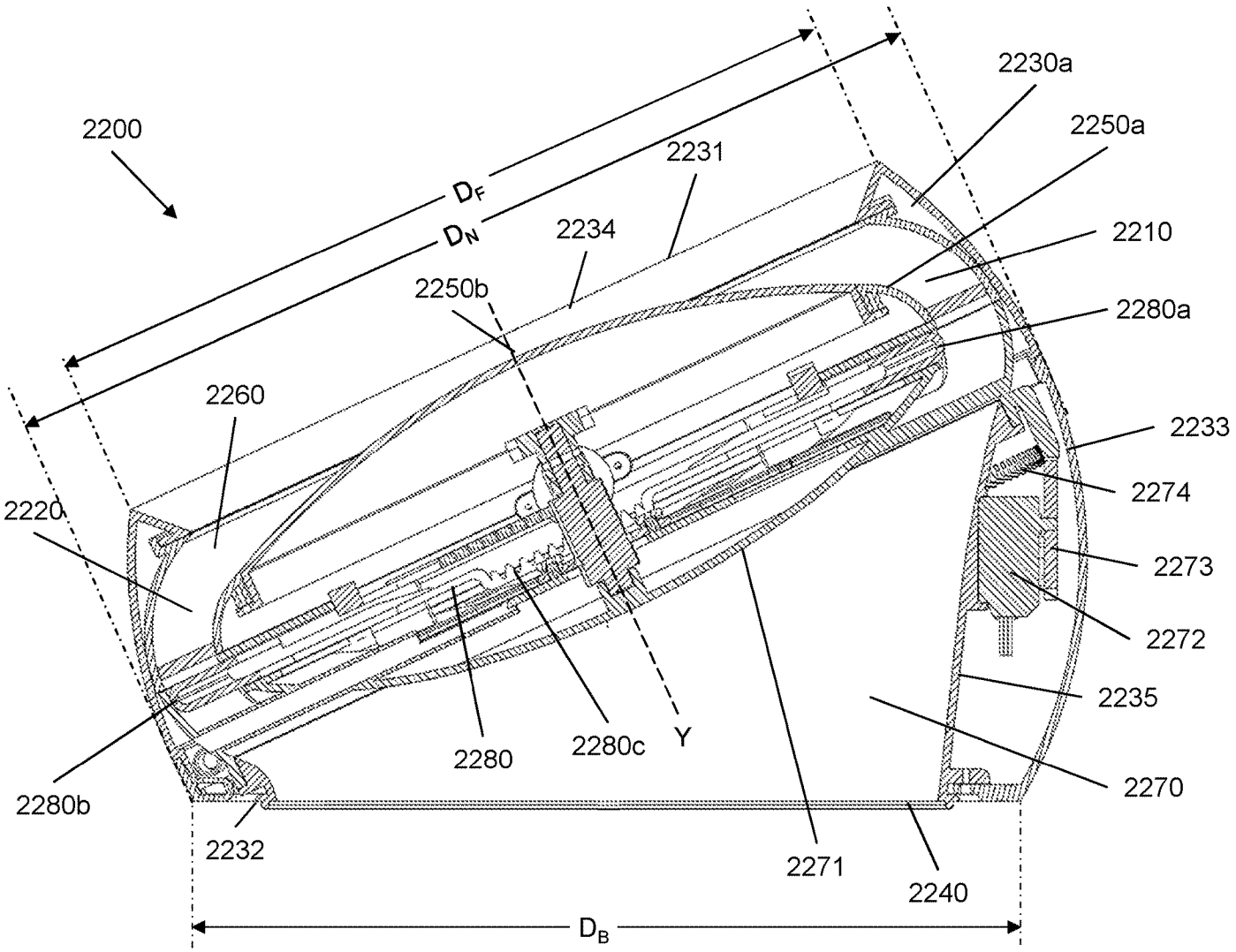
FIG. 11 is a vertical cross-sectional view of the spherical nozzle taken along line A-A of FIG. 9.
Figure 12:
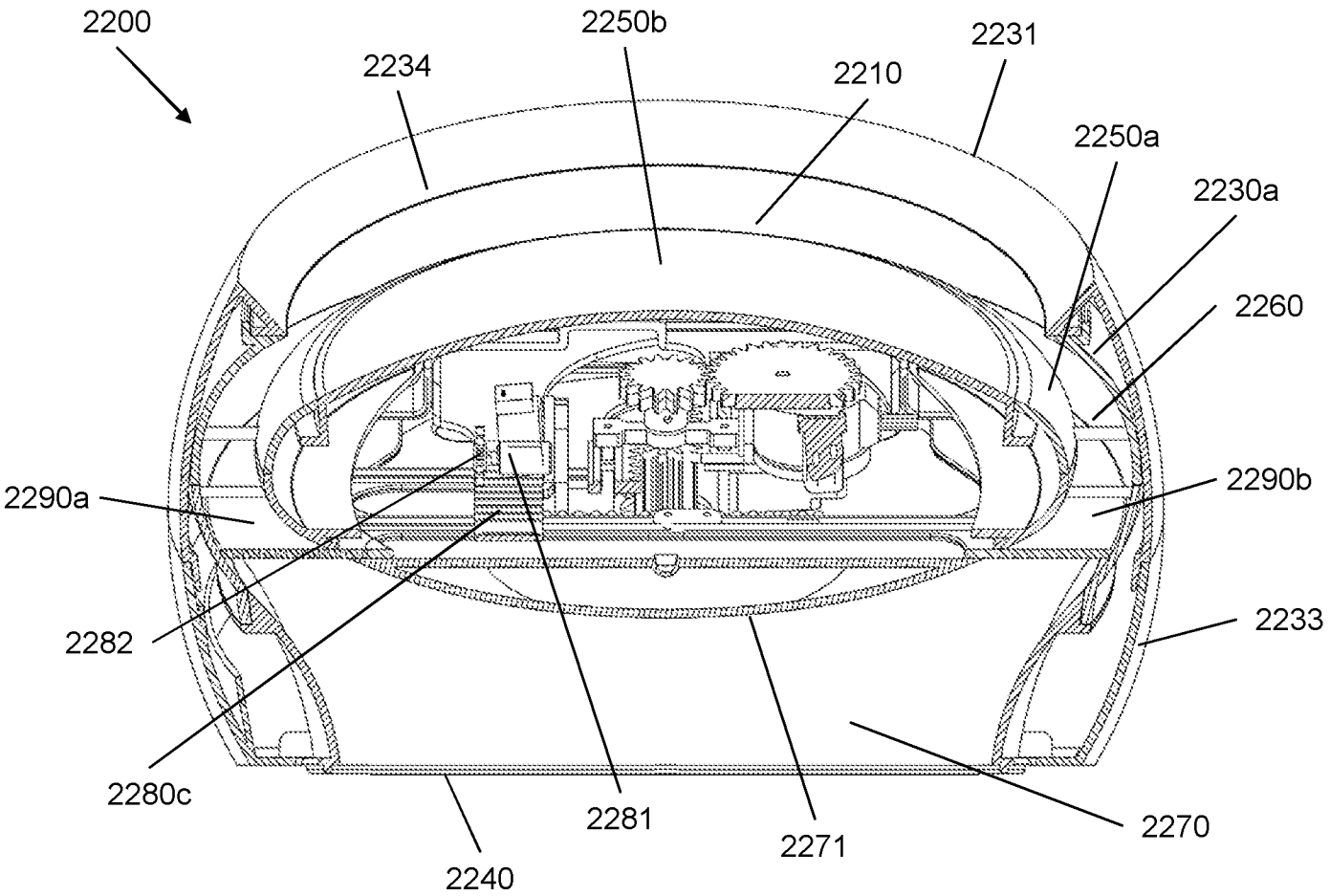
FIG. 12 is a vertical cross-sectional view of the spherical nozzle taken along line B-B of FIG. 10.
Figure 13:
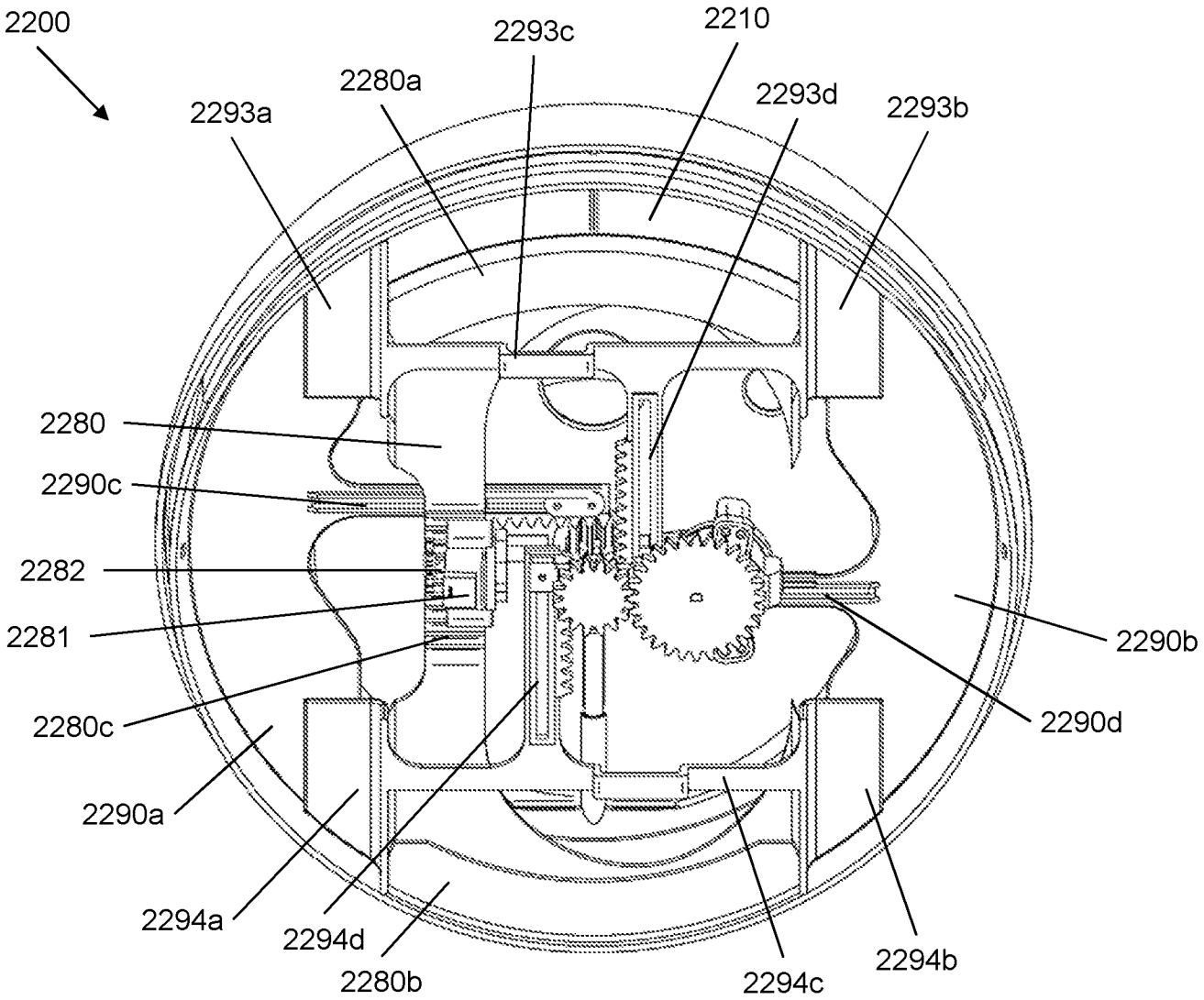
FIG. 13 is a top view of the spherical nozzle of FIG. 7 with an upper portion removed.
Figure 14:
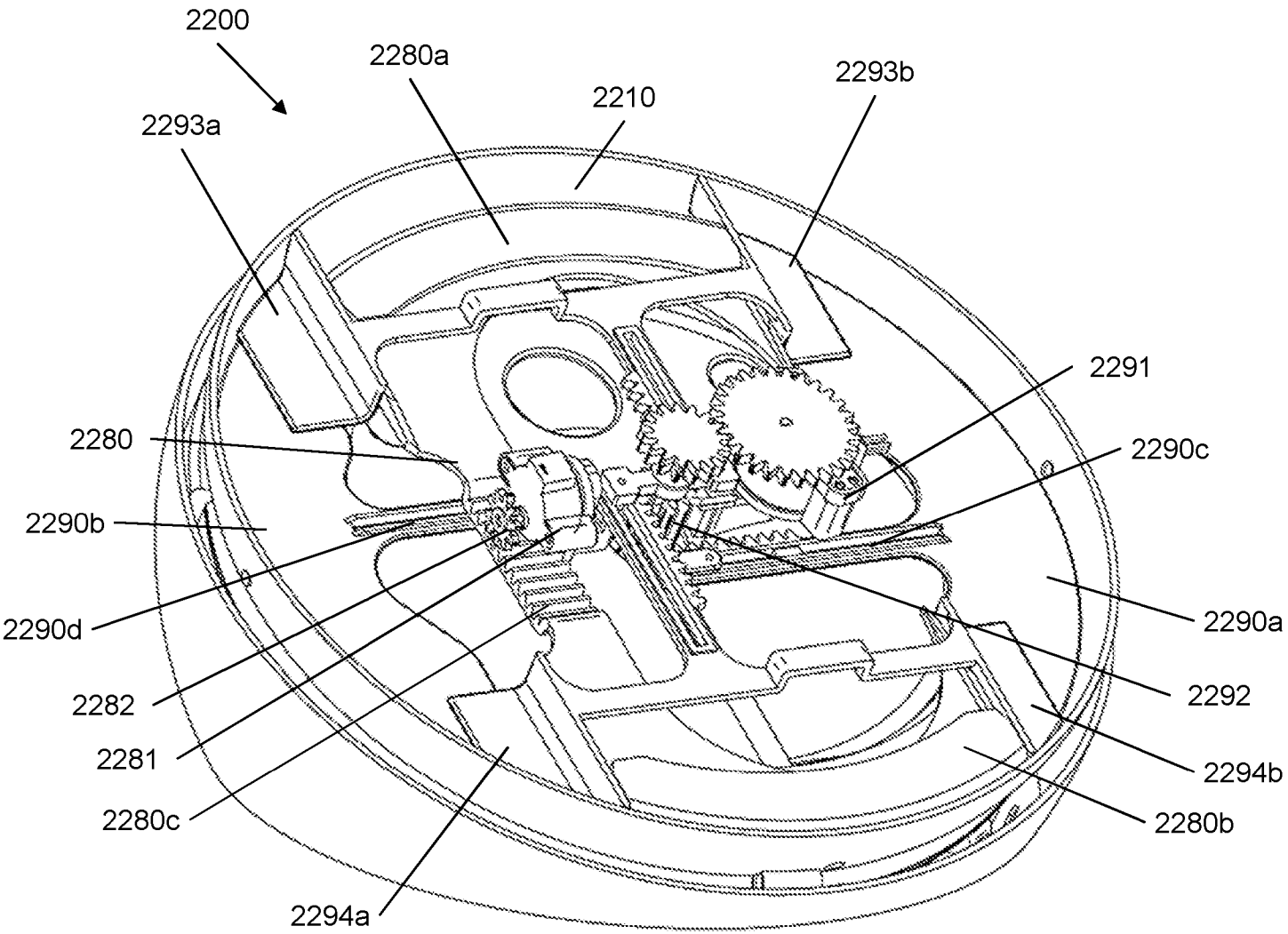
FIG. 14 is a perspective view of the spherical nozzle of FIG. 7 with an upper portion removed.

The construction and operation of the nozzle 2200 will be described in more detail below in relation to FIGS. 7 to 15*c*. FIG. 7 shows a perspective view of the nozzle 2200 of the fan assembly 2000 of FIGS. 5 and 6. FIGS. 8, 9 and 10 then show top, front and side views of the nozzle 2200. FIG. 11 then shows a sectional view through line A-A of FIG. 9, whilst FIG. 12 shows a sectional view through line B-B of FIG. 10. FIGS. 13 and 14 then show top and perspective views of the nozzle 2200 with the guide surface and an upper portion of the nozzle body removed.

As described above, the nozzle 2200 has the general shape of a truncated sphere, with a first truncation forming a circular face 2231 of the nozzle and a second truncation forming a circular base 2232 of the nozzle body 2230. The nozzle body 2230 therefore comprises an outer wall 2233 that defines the truncated spherical shape. The outer wall 2233 then defines a circular opening on the circular face 2231 of the nozzle 2200 and a circular opening on the circular base 2232 of the nozzle body 2230. The nozzle body 2230 also comprises a lip 2234 that extends inwardly from the edge of the outer wall 2233 that forms the first truncation. This lip 2234 is generally frustoconical in shape and tapers inwardly towards the guide surface 2250.

The nozzle body 2230 further comprises an inner wall 2235 that is disposed within the nozzle body 2230 and that defines the single internal air passageway 2270 of the nozzle 2200. The inner wall 2235 is entirely curved and has a generally circular cross-section, with the cross-sectional area of the inner wall 2235 in a plane that is parallel to either the face 2231 or base 2232 of the nozzle body 2230 varying between the air inlet 2240 and the one or more air outlets 2210, 2220. In particular, the inner wall 2235 widens or flares outwardly adjacent the air inlet 2240 and then narrows adjacent the air outlets 2210, 2220. The inner wall 2235 therefore generally conforms to the shape of the nozzle body 2230.

The inner wall 2235 has a circular opening at its lower end that is located concentrically within the circular opening of the circular base 2232 of the nozzle 2200, with this lower circular opening of the inner wall 2235 providing the air inlet 2240 for receiving the airflow from the body 2100. The inner wall 2235 also has a circular opening at its upper end that is located concentrically within the circular opening of the circular face 2231 of the nozzle body 2230. An inwardly curved upper end of the inner wall 2235 then meets/abuts with the lip 2234 that tapers inwardly from the outer wall 2233 to define the circular opening of the circular face 2231 of the nozzle body 2230.

The guide surface 2250 is then located concentrically with the upper circular opening of the inner wall 2235, and offset relative to the upper circular opening of the inner wall 2235 along the central axis of the upper circular opening of the inner wall 2235, such that the gap 2260 is therefore defined by the space between the inner wall 2235 and an adjacent portion of guide surface 2250. The inwardly curved upper end of the inner wall 2235 then overlaps/overhangs the circumferential portion 2250*a* of the guide surface 2250 to ensure that the angle at which an air flow exits the nozzle 2200 is sufficiently shallow to optimise the resultant air flow generated by the nozzle 2200. In particular, the angle at which an air flow exits the nozzle 2200 will determine the distance of the convergent point along the central axis (Y) of the guide surface 2250 and the angle at which air flows will collide at the convergent point. The tapering outer surface of the lip 2234 then minimises the impact of this overhang on the angular range through which the air flow can be varied.

In this embodiment, two separate valve mechanisms are then located beneath the guide surface 2250. The first of these is a flow vectoring valve that is arranged to control the air flow from the air inlet 2240 to the first and second air outlets 2210, 2220 by adjusting the size of the first air outlet 2210 relative to the size of the second air outlet 2220 while keeping the size of the aggregate air outlet of the nozzle 2200 constant. The second of these valve mechanisms is a mode switching valve that is arranged to change the air delivery mode of the nozzle 2200 from a directed mode to a diffuse mode. Both valve mechanisms will be described in more detail below.

The nozzle 2200 further comprises an internal air directing or diverting surface 2271 beneath both valve mechanisms, with the air directing surface 2271 being arranged to direct the airflow within the single air inlet passageway 2270 towards the gap 2260, and therefore towards the first and second air outlets 2210, 2220. In this embodiment, this air directing surface 2271 is convex and substantially disk-shaped, and is therefore similar in form to the guide surface 2250, and is aligned/concentric with the guide surface 2250. Both valve mechanisms are therefore housed within a space defined between the guide surface 2250 and the air directing surface 2271.

In this embodiment, the internal air passageway 2270 that extends between the air inlet 2240 and the gap 2260 forms a plenum chamber that functions to equalise the pressure of the air flow received from the body 2100 of the fan assembly 2000 for more even distribution to the gap 2260, and therefore to the air outlets 2210, 2220. The air directing surface 2271 therefore forms an upper surface of the plenum chamber defined by the internal air passageway 2270.

The flow vectoring valve comprises a single valve member 2280 mounted beneath the guide surface 2250 and above the air directing surface 2271. The flow vectoring valve member 2280 is arranged to move laterally (i.e. translationally) relative to the guide surface 2250 between a first end position and a second end position. In the first end position the first air outlet 2210 is maximally occluded (i.e. occluded to the maximum extent possible, such that the size of the first air outlet is at a minimum) by the valve member 2280 and the second air outlet 2220 is maximally open (i.e. open to the maximum extent possible, such that the size of the second air outlet is at a maximum), whilst in the second end position the second air outlet 2220 is maximally occluded by the valve member 2280 and the first air outlet 2210 is maximally open. When the valve member 2280 moves between its two extreme positions the size/open area of the aggregate/combined air outlet remains constant.

When at a minimum the first and/or second air outlets 2210, 2220 may be fully occluded/closed. However, when at a minimum the first and/or second air outlets 2210, 2220 may be at least open to a very small extent as doing so can provide that any tolerances/inaccuracies arising during manufacture will not lead to small gaps that could induce additional noise (e.g. whistling) when air passes through.

In the illustrated embodiment, the valve member 2280 has a first end section 2280*a* that maximally occludes the first air outlet 2210 when the valve member 2280 is in the first end position, and an opposing second end section 2280*b* that maximally occludes the second air outlet 2220 when the valve member 2280 is in the second end position. The distal edges of the first and second end sections 2280*a*, 2280*b* of the valve member 2280 are both arcuate in shape so as to correspond with the shape of an opposing surface of the nozzle body 2230 that partially defines the corresponding air outlet. In particular, the distal edge of each valve member has a radius of curvature that is substantially equal to a radius of curvature of the opposing surface of the nozzle body 1230. The first end section 2280*a* of the valve member 2280 can therefore abut (i.e. touch or be adjacent/proximate to) an opposing surface when in the first end position in order to occlude the first air outlet 2210, with this opposing surface thereby providing a first valve seat, whilst the second end section 2280*b* of the valve member 2280 can abut (i.e. touch or be adjacent/proximate to) an opposing surface when in the second end position in order to occlude the second air outlet 2220, with this other opposing surface thereby providing a second valve seat. In addition, the arcuate shape of the distal edges of the first and second end sections 2280*a*, 2280*b* of the valve member 2280 also provide that the distal edge of the first end section 2280*a* will be substantially flush with an adjacent edge of the guide surface 2250 when in the second end position and that the distal edge of the second end section 2280*b* will be substantially flush with an adjacent edge of the guide surface 2250 when in in the first end position.

The flow vectoring valve further comprises a valve motor 2281 that is arranged to cause lateral (i.e. translational) movement of the valve member 2280 relative to the guide surface 2250 in response to signals received from the main control circuit. To do so, the valve motor 2281 is arranged to rotate a pinion 2282 that engages with a linear rack 2280*c* provided on the valve member 2280. In this embodiment, the linear rack 2280*c* is provided on an intermediate section of the valve member that extends between the first and second end sections 2280*a*, 2880*b*. Rotation of the pinion 2282 by the valve motor 2281 will therefore result in the linear movement of the valve member 2280.

The mode switching valve is arranged to change the air delivery mode of the nozzle 2200 from a directed mode to a diffuse mode. In the directed mode, the mode switching valve closes off all but the first and second air outlets 2210, 2220 that are used to provide a directed air flow from the nozzle (i.e. covers/occludes those portions of the gap 2260 that separate the pair of arcuate slots). In this directed mode, the flow vectoring valve is then used to control the direction of the air flow emitted from the nozzle 2200 by just the first and second air outlets 2210, 2220. When switching from directed mode to diffuse mode, the mode switching valve opens the remainder of the gap 2260 (i.e. opens those portions of the gap 2260 that separate the pair of arcuate slots). In this diffuse mode, the entire gap 2260 can then become a single air outlet of the nozzle 2200 thereby providing a more diffuse, low pressure flow of air. In addition, the opening up of the entire gap 2260 by the mode switching valve provides that the air leaving the nozzle 2200 can be distributed around the entire periphery/circumference of the guide surface 2250 and all directed to the convergent point such that the resultant air flow generated by the nozzle 2200 will be directed substantially perpendicular relative to the face 2231 of the nozzle 2200. In this embodiment, the angle of the face 2231 of the nozzle 2200 relative to the base 2232 of the nozzle 2200, and therefore relative to the base of the fan assembly 2000, is such that when positioned on an approximately horizontal surface the resultant air flow generated by the fan assembly 2000 when the nozzle 2200 is in the diffuse mode will be directed in a generally upwards direction.

In the illustrated embodiment, the mode switching valve comprises a pair of mode switching valve members 2290*a*, 2290*b* mounted beneath the guide surface 2250 and above the air directing surface 2271. These mode switching valve members 2290*a*, 2290*b* are arranged to move laterally (i.e. translationally) relative to the guide surface 2250 between a closed position and an open position. In the closed position, the portions of the gap 2260 between the arcuate slots (i.e. between the slots that provide the first and second air outlets 2210, 2220) are occluded by the mode switching valve members 2290*a*, 2290*b*, whilst in the open position the portions of the gap 2260 between the arcuate slots are open. These mode switching valve members 2290*a*, 2290*b* can therefore be considered to be moveable covers for those portions of the gap 2260 that are between the arcuate slots.

In the illustrated embodiment, the mode switching valve members 2290*a*, 2290*b* are arranged such that in the closed position they each occlude the separate, diametrically opposed portions of the gap 2260 that are between one end of the first air outlet 2210 and an adjacent end of the second air outlet 2220. To do so, the mode switching valve members 2290*a*, 2290*b* are arranged such that in the closed position they each extend between opposing ends of the first air outlet 2210 and the adjacent end of the second air outlet 2220.

Each of the mode switching valve members 2290*a*, 2290*b* is substantially planar, with a distal edge of the valve member then being arcuate in shape so as to correspond with the shape of an opposing surface of the nozzle body 2230 that partially defines the gap 2260. In particular, the distal edge of each valve member has a radius of curvature that is substantially equal to a radius of curvature of the opposing surface of the nozzle body 1230. The distal edge of each of the valve members 2290*a*, 2290*b* can therefore abut against the opposing surface (i.e. the corresponding valve seat) when in the closed position in order to occlude a portion of the gap 2260 between the arcuate slots. In addition, the arcuate shape of the distal edge of each of the valve members 2290*a*, 2290*b* also provides that the distal edge will be substantially flush with an adjacent edge of the guide surface 2250 when in the open position. Each of the mode switching valve members 2290*a*, 2290*b* is then provided with a valve stem 2290*c*, 2290*d* that extends from the proximal edge of the valve member.

The mode switching valve further comprises a mode switching valve motor 2291 that is arranged to cause lateral (i.e. translational) movement of the mode switching valve members 2290*a*, 2290*b* relative to the guide surface 2250 in response to signals received from the main control circuit. To do so, the valve motor 2291 is arranged to cause rotation of a pinion 2292 that engages with linear racks provided on each of the valve stems 2290*c*, 2290*d*. Rotation of the pinion 2292 by the valve motor 2291 will therefore result in the linear movement of both valve members 2290*a*, 2290*b*. In this embodiment, rotation of the pinion 2292 by the valve motor 2291 is achieved using a set of gears, with a drive gear mounted on the shaft of the valve motor 2291 engaging a driven gear that is fixed to the pinion 2292, with the driven gear and the pinion 2292 thereby forming a compound gear.

In the embodiment illustrated in FIGS. 11 to 14, the mode switching valve further comprises two pairs of movable baffles 2293, 2294 that are arranged to assist with channelling the air emitted from the first and second air outlets 2210, 2220 respectively when the nozzle 2200 is in directed mode. In particular, the first pair of movable baffles 2293*a*, 2293*b* are arranged to assist with channelling the air emitted from the first air outlet 2210 when the nozzle 2200 is in directed mode, whilst the second pair of movable baffles 2294*a*, 2294*b* are arranged to assist with channelling the air emitted from the second air outlet 2220 when the nozzle 2200 is in directed mode. These two pairs of movable baffles 2293, 2294 are therefore arranged to be extended when the nozzle 2200 is in directed mode, and retracted when the nozzle 2200 is in diffuse mode so as to avoid the baffles from obstructing the gap 2260.

Each pair of movable baffles 2293, 2294 comprises a first moveable baffle 2293*a*, 2294*a* and a second moveable baffle 2293*b*, 2294*b*, with the first moveable baffle 2293*a*, 2294*a* and second moveable baffle 2293*b*, 2294*b* being provided at opposite ends of an elongate strut 2293*c*, 2294*c*. Each moveable baffle 2293*a*, 2293*b*, 2294*a*, 2294*b* has an approximately L-shaped cross section, with a first planar section extending downwardly from the end of the strut 2293*c*, 2294*c* to which the baffle is attached, and a second planar section then extending from the bottom end of the first planar section in a direction that is parallel with the length of the strut 2293*c*, 2294*c*. The first and second planar sections of each baffle then also extend in a direction that is perpendicular to the length of the strut 2293*c*, 2294*c*. The first planar section of each baffle then defines an end of one of the first and second air outlets 2210, 2220. A distal edge of the second planar section of each baffle is then arcuate in shape so as to correspond with the shape of an opposing surface of the nozzle body 2230 that partially defines the gap 2260. The distal edge of the second planar section of each baffle can therefore abut against an opposing surface when in the closed position. The second planar section of each baffle is then further arranged to overlap with a portion of the proximal edge of an adjacent mode switching valve member 2290*a*, 2290*b* so as to ensure that there is no route by which air can exit the nozzle 2200 between the baffle and the adjacent mode switching valve member 2290*a*, 2290*b*.

In this embodiment, these pairs of movable baffles 2293, 2294 are arranged to move laterally (i.e. translationally) relative to the guide surface 2250 between an extended position when the nozzle 2200 is in directed mode and a retracted position when the nozzle 2200 is in diffuse mode. To do so, each pair of movable baffles 2293, 2294 is provided with an actuator arm 2293*d*, 2294*d* that extends perpendicularly from the corresponding strut 2293*c*, 2294*c* at a position part-way between the ends of the strut 2293*c*, 2294*c*. These actuator arms 2293*d*, 2294*d* are each provided with a linear rack that engages with the pinion 2292 of the mode switching valve. Rotation of the pinion 2292 by the mode switching valve motor 2291 will therefore result in the linear movement of both pairs of movable baffles 2293, 2294. Consequently, when the mode switching valve is used to change the air delivery mode of nozzle 2200 between directed mode and diffuse mode, activation of the mode switching valve motor 2291 will cause rotation of the pinion 2292 that will in turn cause mode switching valve members 2290*a*, 2290*b* to move between a closed position and an open position, and will also simultaneously cause the pairs of movable baffles 2293, 2294 to move between an extended position and a retracted position.

In FIGS. 11 to 14 the nozzle 2200 is shown in directed mode, with the mode switching valve members 2290*a*, 2290*b* in the closed position and both pairs of movable baffles 2293, 2294 in the extended position. The portions of the gap 2260 that are between the first air outlet 2210 and the second air outlet 2220 are therefore occluded by the mode switching valve members 2290*a*, 2290*b*, with the first planar section of each pair of movable baffles 2293, 2294 then defining opposite ends of the first and second air outlets 2210, 2220 in order to assist in channelling the air over the guide surface 2500 and towards the convergent point.

In order to switch the nozzle 2200 to diffuse mode, the mode switching valve motor 2291 is activated so as to cause a rotation of the pinion 2292 that will in turn cause mode switching valve members 2290*a*, 2290*b* to move from the closed position to the open position. In the open position, the mode switching valve members 2290*a*, 2290*b* are retracted into the space defined between the guide surface 2250 and the air directing surface 2271 such that they no longer obstruct the portions of the gap 2260 that are between the first air outlet 2210 and the second air outlet 2220. Simultaneously, this rotation of the pinion 2292 will also cause the pairs of movable baffles 2293, 2294 to move from the extended position to the retracted position. In the retracted position, the pairs of movable baffles 2293, 2294 are retracted into the space defined between the guide surface 2250 and the air directing surface 2271 such that they no longer obstruct the portions of the gap 2260 that are between the first air outlet 2210 and the second air outlet 2220. Preferably, when switching the nozzle 2200 from directed mode to diffuse mode, the flow vectoring valve motor 2281 is also activated so as to cause a rotation of the pinion 2282 that will in turn cause the flow vectoring valve member 2280 to move to a central position in which the first air outlet 2210 and the second air outlet 2220 are equal in size. In this configuration, the entire gap 2260 then becomes a single air outlet of the nozzle 2200 thereby providing a more diffuse, low pressure flow of air.

In the embodiment illustrated in FIGS. 11 to 14, the nozzle 2200 is also arranged so that the position of the pair of arcuate slots on the circular face of the nozzle 2200 can be varied. Specifically, the angular position of the pair of arcuate slots with respect to the central axis (YY) of the guide surface 2250 is variable. The nozzle 2200 therefore further comprises an outlet rotation motor 2272 that is arranged to cause rotational movement of the pair of arcuate slots around the central axis (YY) of the guide surface 2250. To do so, the outlet rotation motor 2272 is arranged to cause rotation of a pinion 2273 that engages with an arc-shaped rack 2274 that is connected to the air directing surface 2271. The air directing surface 2271 is then rotationally mounted within the nozzle body 2230, with the flow vectoring valve and mode switching valve mechanisms then being supported by the air directing surface 2271. Rotation of the pinion 2273 by the outlet rotation motor 2272 will therefore result in the rotational movement of the air directing surface 2271 within the nozzle body 2230 that will in turn cause rotation of both the flow vectoring valve and mode switching valve around the central axis (YY) of the guide surface 2250. Given that the pair of arcuate slots that form the first and second air outlets 2210, 2220 are defined by those portions of the gap 2260 that are not occluded by the mode switching valve members 2290*a*, 2290*b*, rotation of the mode switching valve results in a change in the angular position of the pair of arcuate slots with respect to the central axis (YY) of the guide surface 2250.

Figure 15A:
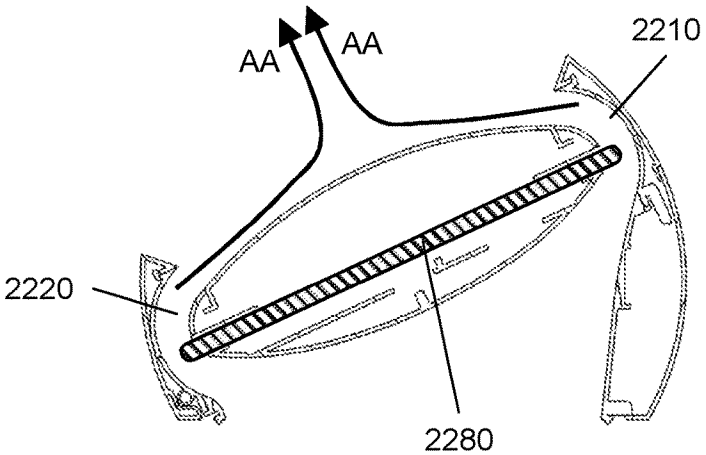
FIG. 15*a* is a simplified vertical cross-sectional view of the spherical nozzle illustrating a valve member in a first position.
Figure 15B:
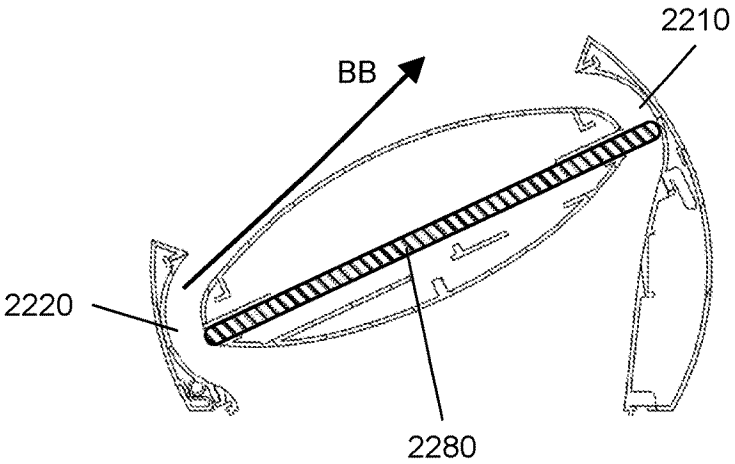
FIG. 15*b* is a simplified vertical cross-sectional view of the spherical nozzle illustrating a valve member in a second position.
Figure 15C:
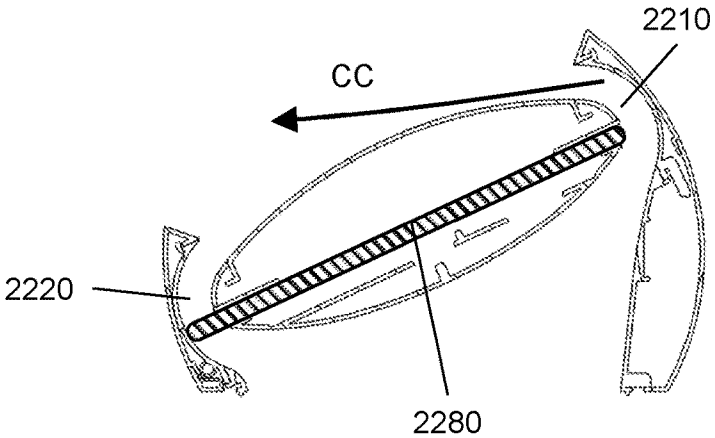
FIG. 15*c* is a simplified vertical cross-sectional view of the spherical nozzle illustrating a valve member in a third position.

Turning now to FIGS. 15*a* to 15*c*, these show three potential resultant air flows that can be achieved, when the nozzle 2200 is in directed mode, by varying the size of the first air outlet 2210 relative to the size of the second air outlet 2220 while keeping the size of the aggregate directed mode air outlet of the nozzle 2200 constant.

In FIG. 15*a*, the flow vectoring valve is arranged with the flow vectoring valve member 2280 in the central position in which the first air outlet 2210 and the second air outlet 2220 are equal in size such that an equal amount of air flow is emitted from the first air outlet 2210 and the second air outlet 2220. The first and second air outlets 2210, 2220 are oriented towards the convergent point that is aligned with the central axis (YY) of the guide surface 2250. When the two air flows have the same strength, as will be the case in the FIG. 15*a*, the resultant air flow will be directed forwards from (i.e. substantially perpendicular relative to) the face 2231 of nozzle 2200, as indicated by arrows AA.

In FIG. 15*b*, the flow vectoring valve is arranged with the flow vectoring valve member 2280 in the first end position in which the first air outlet 2210 is maximally occluded and the second air outlet 2220 is maximally open. This means that most, if not all, of the air flow entering the nozzle 2200 will be emitted through the second air outlet 2220. The air flow will be directed to flow over the guide surface 2250 as normal, but since it will not collide with any significant air flow that is emitted from the first air outlet 2210 it will continue on its flow path, as indicated by arrows BB.

In FIG. 15*c*, the flow vectoring valve is arranged with the flow vectoring valve member 2280 in the second end position in which the second air outlet 2220 is maximally occluded and the first air outlet 2210 is maximally open. This means that most, if not all, of the air flow entering the nozzle 2200 will be emitted through the first air outlet 2210. The air flow will be directed to flow over the guide surface 2250 as normal, but since it will not collide with any significant air flow that is emitted from the second air outlet 2220 it will continue on its flow path, as indicated by arrows CC.

It will be readily understood that the examples of FIGS. 15*a*, 15*b* and 15*c* are merely representative, and actually represent some of the extreme cases. By utilising a control circuit to control the flow vectoring valve motor 2281 connected to the flow vectoring valve member 2280 it is possible to achieve a wide variety of resultant air flows. The direction of the resultant air flows can be further varied by controlling the outlet rotation motor 2272 to adjust the angular position of the first and second air outlets 2210, 2220.

Figure 16:
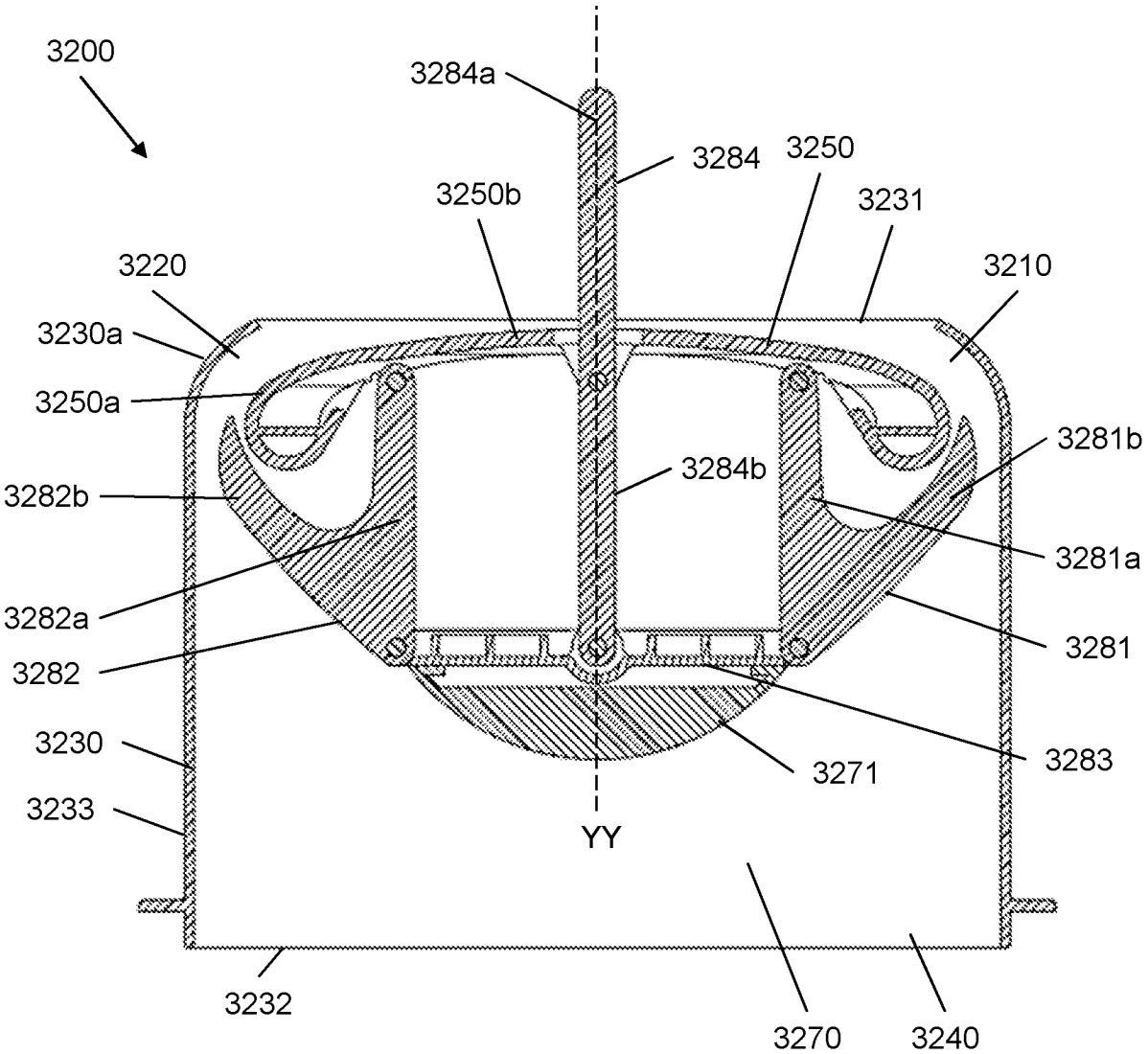
FIG. 16 is a vertical cross-sectional view of a cylindrical nozzle of a second embodiment.
Figure 17B:
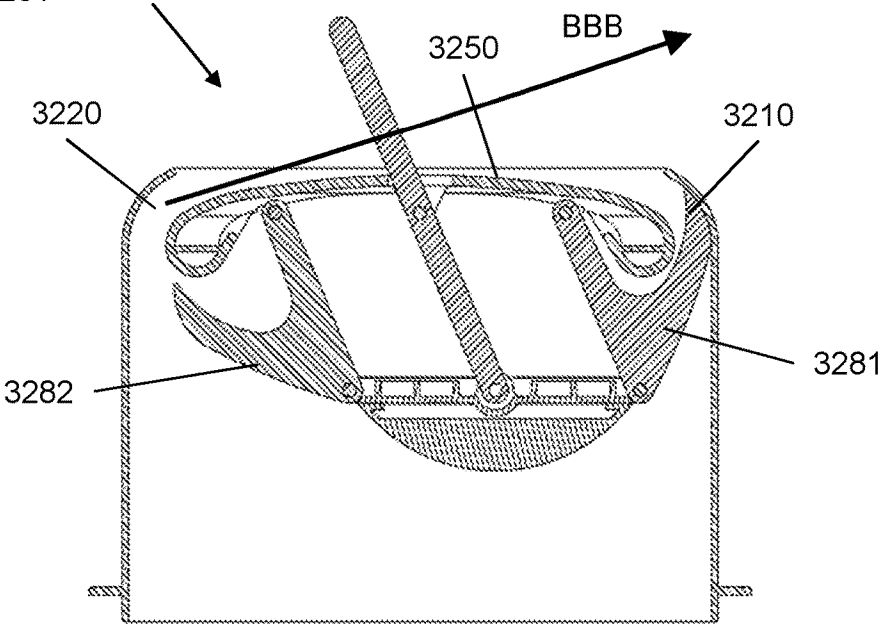
FIG. 17*b* is a vertical cross-sectional view of the cylindrical nozzle illustrating a valve member in a second position.
Figure 17A:
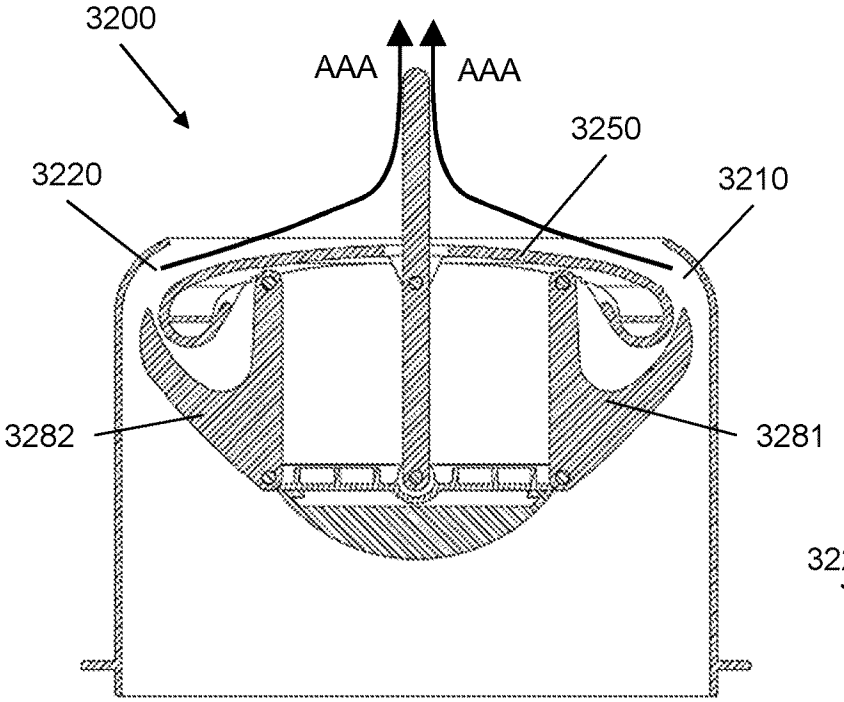
FIG. 17*a* is a vertical cross-sectional view of the cylindrical nozzle illustrating a valve member in a first position.

FIGS. 16, 17*a* and 17*b* then show sectional views of a second embodiment of a nozzle 3200 for a fan assembly. In this second embodiment, the nozzle 3200 is suitable for use with a fan body that is substantially the same as that described above and the fan body has therefore not been further illustrated nor described. However, rather than having a truncated spherical shape, the nozzle 3200 of this further embodiment is generally cylindrical in shape such that there are differences in the construction of the nozzle 3200 and also differences in the flow vectoring valve provided within the nozzle 3200.

In this embodiment, the nozzle 3200 has an open lower end which provides an air inlet 3240 for receiving an airflow from the body of the fan assembly. The nozzle 3200 is arranged such that the external surface of an outer wall of the nozzle 3200 will then converge with the outer edge when mounted on the fan body.

The nozzle 3200 comprises a nozzle body, outer casing or housing 3230 that defines the outermost surfaces of the nozzle and therefore defines the external shape or form of the nozzle 3200. In the illustrated embodiment, the nozzle body/outer casing 3230 of the nozzle 3200 has the general shape of a right circular cylinder, and therefore has a circular face 3231 and a circular base 3232. The angle of the face 3231 of the nozzle body 3230 relative to the base 3232 of the nozzle body 3230 is fixed. In the illustrated embodiment, this angle is 0 degrees such that the circular face 3231 and circular base 3232 are substantially parallel.

The nozzle 3200 then further comprises a fixed, external guide surface 3250 that is located concentrically within the opening at the circular face 3231 of the nozzle body 3230 such that this external guide surface 3250 is at least partially exposed within the opening, with a portion of the nozzle body 3230 extending around the periphery of the guide surface 3250. The external guide surface 3250 is therefore outward facing (i.e. faces away from the centre of the nozzle).

In the illustrated embodiment, this guide surface 3250 is convex and substantially disk-shaped; however, in alternative embodiments the guide surface 3250 could be flat or only partially convex. An inwardly curved upper portion 3230*a* of the nozzle body 3230 then overlaps/overhangs a circumferential portion 3250*a* of the guide surface 3250. The outermost central portion 3250*b* of the convex guide surface is then offset relative to the outermost point of the open circular face 3231 of the nozzle body 3230. In particular, the outermost point of the open circular face 3231 of the nozzle body 3230 is in front of the outermost portion 3250*b* of the guide surface.

The circumferential portion 3250*a* of the guide surface 3250 and an opposing portion of the nozzle body 3230 together define a generally annular gap between them, with two diametrically opposed portions of this gap 3260 then forming a pair of congruent, circular arc shaped slots that provide the first and second air outlets 3210, 3220 of the nozzle 3200. The guide surface 3250 therefore provides an intermediate surface that spans the area between the first and second air outlets 3210, 3220. In other words, the guide surface 3250 forms an intermediate surface that extends across the space that separates the first and second air outlets 3210, 3220. In this embodiment, the portions of the gap that separate the pair of arcuate slots are each occluded by fixed covers (not shown). In contrast with the nozzle 2200 of the first embodiment, the nozzle 3200 of this second embodiment therefore only has a single, directed mode and does not have a separate diffuse mode.

In the illustrated embodiment, the pair of arcuate slots that provide the first and second air outlets 3210, 3220 each have an arc angle (i.e. the angle subtended by the arc at the centre of the circular face 3231) of approximately 60 degrees; however, they could each have an arc angle of anything from 20 to 110 degrees, preferably from 45 to 90 degrees, and more preferably from 60 to 80 degrees.

The first and second air outlets 3210, 3220 are approximately the same size and together form an aggregate or combined air outlet of the spherical nozzle 3200. The first air outlet 3210 and the second air outlet 3220 are located on opposing sides of the guide surface 3250, and are orientated to direct an emitted air flow over a portion of the guide surface 3250 that is adjacent to the respective air outlet and towards a convergent point that is aligned with a central axis (YY) of the guide surface 3250. The first air outlet 3210, the second air outlet 3220 and the guide surface 3250 are then arranged such that emitted air flows are directed over a portion of the guide surface 3250 that is adjacent to the respective air outlet. In particular, the air outlets 3210, 3220 are arranged to emit an air flow in a direction that is substantially parallel to the portion of the guide surface 3250 adjacent the air outlet 3210, 3220. The convex shape of the guide surface 3250 then provides that the air flows emitted from the first and second air outlets 3210, 3220 will depart from the guide surface 3250 as they approach the convergent point so that these air flows can collide at and/or around the convergent point without interference from the guide surface 3250. When the emitted air flows collide, a separation bubble is formed that can assist in stabilizing the resultant jet or combined air flow formed when two opposing air flows collide.

In this embodiment, the nozzle body 3230 comprises an outer wall 3233 that defines the cylindrical shape of the nozzle 3200 and the single internal air passageway 3270 of the nozzle 3200. The outer wall 3233 also defines the circular opening on the circular face 3231 of the nozzle 3200 and the circular opening on the circular base 3232 of the nozzle body 3230. The lower circular opening of the outer wall 3233 provides the air inlet 3240 for receiving the airflow from the fan body. The nozzle body 3230 also comprises the upper portion 3230*a* that curves inwardly towards the central axis of the guide surface 3250.

The guide surface 3250 is then located concentrically with the upper circular opening of the outer wall 3233, and offset relative to the upper circular opening of the outer wall 3233 along the central axis of the upper circular opening of the outer wall 3233, such that the gap is therefore defined by the space between the upper circular opening of the outer wall 3233 and an adjacent portion of guide surface 3250.

A flow vectoring valve is then located beneath the guide surface 3250. The flow vectoring valve is arranged to control the air flow from the air inlet to the first and second air outlets 3210, 3220 by adjusting the size of the first air outlet 3210 relative to the size of the second air outlet 3220 while keeping the size of the aggregate air outlet of the nozzle 3200 constant.

The flow vectoring valve comprises a first valve member 3281 and a second valve member 3282 that cooperate to adjust the size of the first air outlet 3281 relative to the size of the second air outlet 3282 while keeping the total air outlet of the nozzle 3200 constant. To do, the first valve member 3281 and the second valve member 3282 are linked so that they move simultaneously. The first valve member 3281 and the second valve member 3282 are therefore each arranged to be pivotable relative to the both the nozzle body 3230 and the guide surface 3250 between a first end position and a second end position. In the first end position the first air outlet 3210 is maximally occluded (i.e. occluded to the maximum extent possible, such that the size of the first air outlet is at a minimum) by the first valve member 3281 whilst the second air outlet 3220 is maximally open (i.e. open to the maximum extent possible, such that the size of the second air outlet is at a maximum). In the second end position the second air outlet 3220 is maximally occluded by the second valve member 3282 whilst the first air outlet 3210 is maximally open.

When at a minimum the first and/or second air outlets 3210, 3220 may be fully occluded/closed. However, when at a minimum the first and/or second air outlets 3210, 3220 may be at least open to a very small extent as doing so can provide that any tolerances/inaccuracies arising during manufacture will not lead to small gaps that could induce additional noise (e.g. whistling) when air passes through.

In this embodiment, the first valve member 3281 is pivotally mounted beneath the guide surface 3250 at a location adjacent to the first air outlet 3210 and the second valve member 3282 is pivotally mounted beneath the guide surface 3250 at a location adjacent to the second air outlet 3220. The first valve member 3281 is then linked to the second valve member 3282 by a coupler 3283 such that first valve member 3281 and the second valve member 3283 pivot simultaneously. The guide surface 3250, first valve member 3281, second valve member 3282 and the coupler 3283 therefore form a planar quadrilateral linkage, specifically a parallelogram four-bar linkage. The first valve member 3281 and the second valve member 3282 therefore each comprise a link portion 3281*a*, 3282*a*, with a first end of the link portion being connected to the coupler 3283 by a hinge and a second end of the link portion being connected to the underside of the guide surface 3250 by another hinge. These link portions of the first and second valve members 3281, 3282 therefore function as cranks of the four-bar linkage.

The first valve member 3281 then further comprises a first valve arm 3281*b* that is arranged to maximally occlude the first air outlet 3210 when the first valve member 3281 is in the first end position and the second valve member 3282 further comprises a second valve arm 3282*b* that is arranged to maximally occlude the second air outlet 3220 when the valve member 3282 is in the second end position. The first valve arm 3281*b* extends from the first valve member 3281 into the first air outlet 3210 and the second valve arm 3282*b* extends from the second valve member 3282 into the second air outlet 3220. In particular, the first valve arm 3281*b* extends from the first end of the link portion 3281*a* of the first valve member 3281, and the second valve arm 3282*b* extends from the first end of the link portion 3282*a* of the second valve member 3282.

The flow vectoring valve further comprises a rod 3284 that is connected to the coupler 3283 such that movement of the rod 3284 causes simultaneous movement of the first valve member 3281 and second valve member 3282. In this embodiment, the rod 3284 extends out of the nozzle 3200 through the centre of the guide surface 3250, with an external portion 3284*a* of the rod 3284 being arranged to provide a user operable handle and an internal portion 3284*b* of the rod 3284 being pivotally connected to the coupler 3283. Between the external portion 3284*a* of the rod 3284 and the pivotal connection of the rod 3284 to the coupler 3283, the rod 3284 is then also pivotally connected just beneath the guide surface 2050.

The nozzle 3200 then further comprises an internal air directing/diverting surface 3271 disposed between the first valve member 3281 and the second valve member 3282 that is arranged to direct an airflow received from/within the single air inlet passageway 3270 towards the first and second air outlets 3210, 3220. In this embodiment, this air directing surface 3271 is convex, is substantially disk-shaped, and is mounted on to the lower surface of the coupler 3283. The air directing surface 3271 therefore moves with the coupler 3283 and is at all times disposed between the rearmost ends of the first valve member 3281 and the second valve member 3282 irrespective of the positions of the first valve member 3281 and the second valve member 3282. In addition, the surfaces of each of the first valve arm 3281*b* and the second valve arm 3282*b* that face the single internal air passageway 3270 are then also arranged to direct an airflow received from/within the single air inlet passageway 3270 towards the first and second air outlets 3210, 3220 respectively. In particular, these air directing surfaces of each of the first valve arm 3281*b* and the second valve arm 3282*b* are arranged to be generally continuous with the air directing surface 3271.

In this embodiment, the internal air passageway 3270 that extends between the air inlet 3240 and the first and second air outlets 3210, 3220 forms a plenum chamber that functions to equalise the pressure of the air flow received from the fan body for more even distribution to the first and second air outlets 3210, 3220. The air directing surface 3271 therefore forms an upper surface of the plenum chamber defined by the internal air passageway 3270.

FIGS. 17*a* and 17*b* show two potential resultant air flows that can be achieved by varying the size of the first air outlet 3210 relative to the size of the second air outlet 3220 while keeping the size of the aggregate air outlet of the nozzle 3200 constant.

In FIG. 17*a*, the flow vectoring valve is arranged with the first and second valve members 3281, 3282 in the central position in which the first air outlet 3210 and the second air outlet 3220 are equal in size such that an equal amount of air flow is emitted from the first air outlet 3210 and the second air outlet 3220. The first and second air outlets 3210, 3220 are oriented towards the convergent point that is aligned with a central axis (YY) of the guide surface 3250. When, as will be the case in the FIG. 17*a* the two air flows have the same strength, the resultant air flow will be directed forwards from (i.e. substantially perpendicular relative to) the face 3231 of nozzle 3200, as indicated by arrows AAA.

In FIG. 17*b*, the flow vectoring valve is arranged with the first valve member 3281 and second valve member 3282 in the first end position in which the first air outlet 3210 is maximally occluded and the second air outlet 2220 is maximally open. This means that most, if not all, of the air flow entering the nozzle 3200 will be emitted through the second air outlet 3220. The air flow will be directed to flow over the guide surface 3250 as normal, but since it will not collide with any significant air flow that is emitted from the first air outlet 3210 it will continue on its flow path, as indicated by arrows BB.

It will be readily understood that the examples of FIGS. 17*a* and 17*b* are merely representative, and actually represent some of the extreme cases. By utilising the user operable handle portion of the rod 3284 that is connected to the flow vectoring valve members 3281, 3282 it is possible to achieve a wide variety of resultant air flows.

Figure 18:
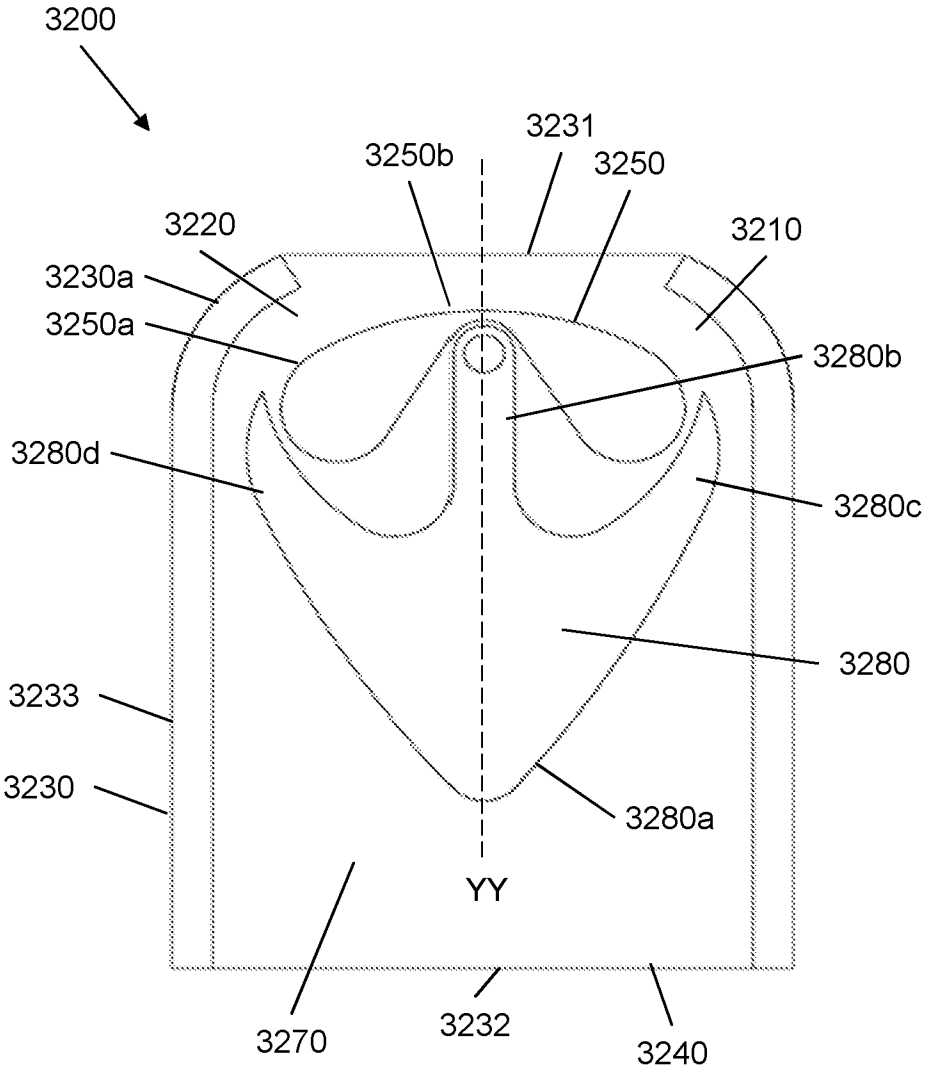
FIG. 18 is a simplified vertical cross-sectional view an alternative embodiment of a flow vectoring valve for the cylindrical nozzle of FIG. 16.

FIG. 18 shows an alternative embodiment of the flow vectoring valve to that of the second embodiment. Whilst the flow vectoring valve of the second embodiment comprises a pair of linked pivoting valve members, the flow vectoring valve of this alternative embodiment makes use of a single pivoting valve member 3280. In the embodiment of FIG. 18, the flow vectoring valve therefore comprises a single valve member 3280 that is pivotally mounted directly behind the central axis (YY) of the guide surface 3250. The valve member 3280 comprises a valve member body having a rear air directing surface 3280*a*, a central hinge arm 3280*b* that extends from the front surface of the valve member body and that pivotally connects the valve member 3280 behind the guide surface 3250, and a pair of opposing valve arms 3280*c*, 3280*d* that extend toward the first and second air outlets 3210, 3220 respectively. In use the valve member 3280 can then pivot in a first direction such that the first valve arm 3280*c* moves into and closes off/occludes the first air outlet 3210, and can pivot in a second direction, opposite to the first direction, such that the second valve arm 3280*d* moves into and closes off/occludes the second air outlet

3220. In this embodiment, rather than having a smooth convex rear air directing surface, the rear air directing surface 3280*a* of the valve member 3280 has a more pointed shape that directs or deflects an airflow within the single internal air passageway 3270 towards the first and second air outlets 3210, 3220. The first and second valve arms 3280*c*, 3280*d* then preferably extend from opposing sides of the directing surface 3280*a* and are continuous with the directing surface 3280*a*.

It will be appreciated that individual items described above may be used on their own or in combination with other items shown in the drawings or described in the description and that items mentioned in the same passage as each other or the same drawing as each other need not be used in combination with each other. In addition, the expression "means" may be replaced by actuator or system or device as may be desirable. In addition, any reference to "comprising" or "consisting" is not intended to be limiting in any way whatsoever and the reader should interpret the description and claims accordingly.

Furthermore, although the invention has been described in terms of preferred embodiments as set forth above, it should be understood that these embodiments are illustrative only. Those skilled in the art will be able to make modifications and alternatives in view of the disclosure which are contemplated as falling within the scope of the appended claims. For example, those skilled in the art will appreciate that the above-described invention might be equally applicable to other types of environmental control fan assemblies, and not just free standing fan assemblies. By way of example, such a fan assembly could be any of a freestanding fan assembly, a ceiling or wall mounted fan assembly and an in-vehicle fan assembly.

By way of further example, each of the flow vectoring valve mechanisms described above are interchangeable between the nozzle embodiments. In particular, a single linearly moveable valve member such as that described in relation to the first embodiment could be used in the second embodiment. A single pivoting valve member or a pair of linked pivoting valve members such as that described in relation to the second embodiment could also be used in the first nozzle embodiment.

In addition, whilst in the first embodiment the portions of the gap between the first and second directed mode air outlets are occluded by moveable covers, they could equally be occluded by fixed covers, as is the case in the second embodiment, such that the nozzle of the first embodiment would then only have a single directed mode of air delivery. Inversely, the fixed covers of the second embodiment could be replaced by moveable covers such as those described in relation to the first embodiment, thereby providing the nozzle of the second embodiment with both directed and diffuse air delivery modes.

This dual mode configuration is particularly useful when the nozzle is intended for use with a fan assembly that is configured to provide purified air as the user of such a fan assembly may wish to continue to receive purified air from the fan assembly without the cooling effect produced by the higher pressure, focussed airflow provided in directed mode. For example, this may be the case in winter when the user may consider the temperature to be too low to make use of the cooling effect provided by the directed mode airflow. In such a situation, the user can control the air delivery mode by manipulating the user interface. In response to these user inputs, a main control circuit would then cause the mode switching valve members to move from the closed position to the open position so that the entire gap then becomes a single air outlet of the nozzle thereby providing a more diffuse, low pressure flow of air. Furthermore, in preferred embodiments, the angle of the face of the nozzle relative to the base of the nozzle, and therefore relative to the base of the fan assembly, is such that when positioned on an approximately horizontal surface the resultant air flow generated by the fan assembly when the nozzle is in the diffuse mode will be directed in a generally upwards direction. These embodiments therefore also provide that the diffuse mode airflow is delivered to the user indirectly, thereby further decreasing the cooling effect produced by the airflow.

Furthermore, the nozzles and outlets of the above described embodiments could have different shapes. For example, rather than having the general shape of a circular arc, the slots that provide the first and second air outlets could each be non-circular, elliptical arcs. Similarly, rather than having the general shape of a sphere, the nozzle of the first embodiment could have the general shape of a non-spherical ellipsoid or spheroid. The nozzle of the first embodiment could also have the general shape of an elliptic cylinder, rather than having the general shape of a right circular cylinder. Also, the face of the nozzle could also differ in shape. In particular, rather than being circular, the face of the nozzle could have the shape of a non-circular ellipse.

Additionally, whilst in the above described embodiments air is prevented from exiting the portions of the gap that separate the first and second air outlets by fixed or moveable covers that occlude these portions, in an alternative embodiment the single internal air passageway could be shaped so that the air flow does not reach these portions of the gap. In particular, the single internal air passageway could be provided with sidewalls that are generally parallel with and extend between the end of the curved slot that provides the first air outlet and an adjacent end of the curved slot that provides the second air outlet. The single internal air passageway would then not extend beyond the ends of the air outlets and would only extend from the distal curved side/edge of one air outlet to the distal curved side/edge of the other outlet, and under the corresponding portion of the intermediate/guide surface. The single internal air passageway would still provide a plenum region for the air flow received through the air inlet of the nozzle but would restrict this to a region below and between the air outlets.

Moreover, whilst some of the above described embodiments make use of a valve motor for driving the movement of one or more valve members, all of the nozzles described herein could alternatively include a manual mechanism for driving the movement of the valve member(s), wherein the application of a force by the user would be translated into movement of the valve member(s). For example, this could take the form of a rotatable dial or wheel or a sliding dial or switch, with rotation or sliding of the dial by a user causing rotation of a pinion.

The invention claimed is:

1. A nozzle for a fan assembly, the nozzle comprising:

a nozzle body;

an air inlet for receiving an air flow, a first air outlet for emitting a first portion of the air flow and a second air outlet for emitting a second portion of the air flow; and an intermediate surface located within an opening of the nozzle body;

wherein the first and second air outlets comprise a pair of curved slots that are provided on diametrically opposed portions of a face of the nozzle, the first and second air outlets being at least partially formed between a portion of the nozzle body and a portion of the intermediate surface;

wherein the first and second air outlets are oriented towards a convergent point such that the first portion of the air flow and the second portion of the airflow collide at or around the convergent point; and wherein the intermediate surface at least partially extends beyond, and spans an area between, the first and second air outlets, wherein the first portion of the air flow and the second portion of the air flow are directed over at least a portion of the intermediate surface towards the convergent point; and wherein the intermediate surface between the first and second air outlets is convex toward the convergent point.

2. The nozzle of claim 1, wherein the face of the nozzle comprises the intermediate surface.

3. The nozzle of claim 1, wherein the convergent point is located on a central axis of the face of the nozzle.

4. The nozzle of claim 1, wherein the nozzle body defines one or more outermost surfaces of the nozzle.

5. The nozzle of claim 4, wherein the face of the nozzle further comprises a portion of the nozzle body that extends around the periphery of the intermediate surface.

6. The nozzle of claim 4, wherein the intermediate surface is exposed within the opening.

7. The nozzle of claim 1, wherein the first air outlet is defined by a first portion of the nozzle body and a first portion of the intermediate surface and the second air outlet is defined by a second portion of the nozzle body and a second portion of the intermediate surf ace.

8. The nozzle of claim 7, wherein the first portion of the nozzle body has a shape that corresponds with a shape of the first portion of the intermediate surface and the second portion of the nozzle body has a shape that corresponds with a shape of the second portion of the intermediate surface.

9. The nozzle of claim 8, wherein the nozzle defines an opening between the intermediate surface and the nozzle body, and wherein the pair of curved slots are provided by separate portions of the opening.

10. The nozzle of claim 9, wherein portions of the opening between the pair of curved slots are each occluded by one or more covers.

11. The nozzle of claim 1, wherein the nozzle has a shape of a truncated sphere, with a first truncation defining the face of the nozzle and a second truncation defining at least part of a base of the nozzle.

12. The nozzle of claim 1, and further comprising a base that is arranged to be connected to a fan assembly, and wherein the base defines the air inlet of the nozzle.

13. The nozzle of claim 12, wherein an angle of the face of the nozzle relative to the base is fixed.

14. The nozzle of claim 13, wherein the angle of the face of the nozzle relative to the base is from 0 to 90 degrees.

15. The nozzle of claim 1, and further comprising a single internal air passageway extending between the air inlet and both the first and second air outlets.

16. The nozzle of claim 15, and further comprising a valve for controlling an air flow from the air inlet to the air outlets.

17. The nozzle of claim 16, wherein the first and second air outlets together define a combined air outlet of the nozzle, and the valve comprises one or more valve members which are moveable to adjust the size of the first air outlet relative to the size of the second air outlet while keeping the size of the combined air outlet of the nozzle constant.

18. The nozzle of claim 16, wherein one or more valve members are moveable through a range of positions between a first end position in which the first air outlet is maximally occluded and the second air outlet is maximally open and a second end position in which the first air outlet is maximally open and the second air outlet is maximally occluded.

19. A fan assembly comprising an impeller, a motor for rotating the impeller to generate an air flow, and the nozzle of claim 1 for receiving the air flow.

* * * * *